US009315047B2

(12) United States Patent
Iton et al.

(10) Patent No.: US 9,315,047 B2
(45) Date of Patent: Apr. 19, 2016

(54) VELOCITY ESTIMATION METHODS, AND IMAGING DEVICES AND PRINTING DEVICES USING THE METHODS

(71) Applicant: HEWLETT-PACKARD INDIGO B.V., Amstelveen (NL)

(72) Inventors: Liron Iton, Nes Ziona (IL); Oren Haik, Nes Ziona (IL); Oded Perry, Nes Ziona (IL); Tal Frank, Nes Ziona (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 224 days.

(21) Appl. No.: 13/872,299

(22) Filed: Apr. 29, 2013

(65) Prior Publication Data

US 2014/0320565 A1 Oct. 30, 2014

(51) Int. Cl.

| | |
|---|---|
| ***B41J 11/42*** | (2006.01) |
| ***B41J 29/393*** | (2006.01) |
| ***B41J 13/26*** | (2006.01) |
| ***B41J 13/32*** | (2006.01) |
| ***B41J 15/04*** | (2006.01) |
| ***B41J 11/00*** | (2006.01) |

(52) U.S. Cl.

CPC ..... *B41J 11/42* (2013.01); *B41J 11/0095* (2013.01); *B41J 13/26* (2013.01); *B41J 13/32* (2013.01); *B41J 15/046* (2013.01); *B41J 29/393* (2013.01)

(58) Field of Classification Search

None

See application file for complete search history.

(56) References Cited

U.S. PATENT DOCUMENTS

| | | | | |
|---|---|---|---|---|
| 6,317,219 | B1 | 11/2001 | Kim | |
| 8,363,261 | B1 | 1/2013 | Zimmerman | |
| 2005/0052704 | A1 | 3/2005 | Kim | |
| 2009/0317104 | A1* | 12/2009 | Katoh et al. | 399/49 |
| 2010/0123752 | A1* | 5/2010 | Eun et al. | 347/19 |
| 2011/0007371 | A1 | 1/2011 | Yip | |
| 2011/0316925 | A1* | 12/2011 | Saita | 347/19 |
| 2012/0206531 | A1 | 8/2012 | Mizes | |

OTHER PUBLICATIONS

Oren Haik et al., Superresolution reconstruction of a video captured by a vibrated time delay and integration camera, Journal of Electronic Imaging 15(2), 023006 (Apr.-Jun. 2006) (12 pages).

Michael T. Snella, Drift Correction for Scanning-Electron Microscopy submitted to the Department of Electrical Engineering and Computer Science in partial fullfillment of the requirements for the degree of Master of Engineering in Electrical Engineering and Computer Science at the Massachusetts Institute of Technology, Sep. 2010 (92 pages).

* cited by examiner

*Primary Examiner* — Justin Seo

(57) ABSTRACT

A method of determining the velocity of relative displacement between a substrate and an image sensor, for example the velocity of displacement of a page relative to a scanner, involves imaging a reference pattern on the substrate, using the image sensor, while the relative displacement occurs between the substrate and the image sensor. The reference pattern includes plural crossing points marked at predetermined locations on the substrate, each crossing point formed of a first line portion crossing a second line portion. Locations in the image that correspond to the crossing points are compared to the predetermined locations on the substrate and the velocity of the relative displacement between the image sensor and the substrate is determined using relationships between the predetermined locations and the detected locations in the generated image.

16 Claims, 11 Drawing Sheets

$$(y_{min}, x_{min}) = \text{Find}\left(\min\left(abs(y - y_{image}) + abs(x - x_{image})\right)\right)$$

$$M = \min\left(abs(y_{onscan\ line} - (\bar{y}+j)', (\bar{x}+i)'\ Color\ on\ Y\ image) + abs(x_{onscan\ line} - (\bar{y}+j)', (\bar{x}+i)'\ Color\ on\ X\ image)\right)$$

$$y', x' = (\bar{y}+j)'_{M'}, (\bar{x}+i)'_{M}$$

$$-(Block\ search\ height Y)/2 < j < (Block\ search\ height)/2$$

$$-(Block\ search\ width\ Y)/2 < i < (Block\ search\ width)/2$$

$$y_{on\ scan\ line} > y',x'\ Color\ on\ Y\ image$$
$$x_{on\ scan\ line} < y',x'\ Color\ on\ X\ image$$

$$y'_{Sub\ Pixel} = \frac{y_{on\ scan\ line} - y',x'\ Color\ on\ Y\ image}{(y+1)',x'\ Color\ on\ Y\ image - y',x'\ Color\ on\ Y\ image}$$

$$x'_{Sub\ Pixel} = (x-1)' + \frac{x_{on\ scan\ line} - y',(x-1)'\ Color\ on\ X\ image}{y',x'\ Color\ on\ X\ image - y',(x-1)'\ Color\ on\ X\ image}$$

FIG.10

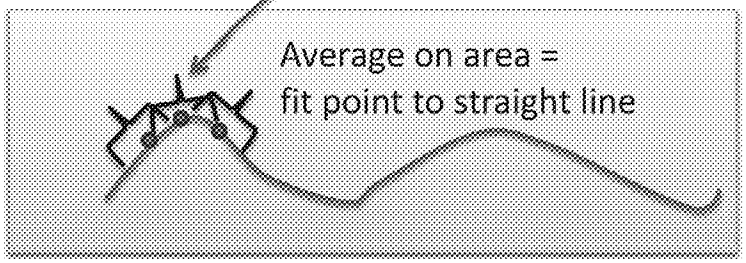

convolve with constant kernel = Savitzky–Golay order 0

The real rotation point minimizes the acceleration

Small area constant velocity assumption $$\begin{pmatrix} v_{y1}', v_{y2}', v_{y3}' \ldots, v_{yn}' \\ v_{x1}', v_{x2}', v_{x3}' \ldots, v_{xn}' \end{pmatrix} = \begin{pmatrix} -x_0 & v_y \\ y_0 & v_x \end{pmatrix} \begin{pmatrix} w_1 & w_2 & w_3 & \ldots & w_n \\ 1 & 1 & 1 & \ldots & 1 \end{pmatrix}$$

Small area constant acceleration assumption $$\begin{pmatrix} v_{y1}', v_{y2}', v_{y3}' \ldots, v_{yn}' \\ v_{x1}', v_{x2}', v_{x3}' \ldots, v_{xn}' \end{pmatrix} = \begin{pmatrix} -x_0 & v_y & a_y \\ y_0 & v_x & a_x \end{pmatrix} \begin{pmatrix} w_1 & w_2 & w_3 & \ldots & w_n \\ 1 & 1 & 1 & \ldots & 1 \\ 1 & 2 & 3 & \ldots & n \end{pmatrix}$$

VELOCITY ESTIMATION METHODS, AND IMAGING DEVICES AND PRINTING DEVICES USING THE METHODS

BACKGROUND

In various applications, imaging devices are arranged to generate images of markings (letters, symbols, graphics, photographs, and so on) that they detect on a substrate while relative motion occurs between the substrate and a sensing unit in the imaging device. For instance, some printing devices include an optical scanner to scan the images that have been printed and this scanning is performed, for example, for quality assurance purposes and/or for the purpose of diagnosing defects or malfunctions affecting components of the printing device. In some cases the substrate is transported past a stationary sensing unit of the imaging device so that an image can be generated of the markings on the whole of the substrate (or on a selected portion of the substrate), and in some other cases the substrate is stationary and the sensing unit of the imaging device is transported relative to the substrate. The sensing unit may take any convenient form, for example it may employ TDI (time delay integration) devices, charge-coupled devices, contact image sensors, cameras, and so on.

In some applications a digital representation of a target image is supplied to a printing device, the printing device prints the target image on a substrate and then the target image on the substrate is scanned by an imaging device included in or associated with the printing device. The scan image generated by the imaging device may then be compared with the original digital representation for various purposes, for example: to detect defects in the operation of the printer, for calibration purposes, and so on.

In some cases the imaging device has a sensing unit that senses markings on a whole strip or line across the whole width of the substrate at the same time, and generates a line image representing those markings, then senses markings on successive lines across the substrate in successive time periods: here such a sensing unit shall be referred to as an in-line sensing unit. For example, an in-line sensing unit may include an array of contiguous sensing elements that, in combination, span the whole width of the substrate. A simple form of in-line sensing device includes a one-dimensional array of sensing elements. However, in certain technologies—for example TDI—plural rows of sensors may be provided and the line image may then be produced by averaging (to reduce noise). The number of sensing elements in the array, and the exposure time over which each sensing element/array integrates its input to produce its output, may be varied depending on the requirements of the application. A clock pulse generator may be used to synchronize the measurement timing of the in-line sensing unit so that in each of a series of successive periods (called either "detection periods" or "scan periods" below) the sensing unit generates an image of a respective line across the substrate.

Such an imaging device may include a processor that is arranged to process the signals output by the in-line sensing unit to create a two-dimensional scan image of the markings on the substrate by positioning the sensing-unit output measured at each detection time along a line at a spatial location, in the scan image, which corresponds to the detection time (taking into account the speed and direction of the relative displacement between the substrate and the in-line sensing unit). The duration of each detection period may be very short, and the interval between successive detection periods may also very short, so that in a brief period of time the imaging device can construct a scan image that appears to the naked eye to be continuous in space (i.e. a viewer of the scan image cannot see the constituent lines).

If the relative motion between the substrate and the in-line sensing unit occurs at a constant linear velocity in the lengthwise direction of the substrate then the positions on the substrate that are imaged by the in-line sensing unit at successive detection times are disposed along parallel lines that are spaced apart by equal distances in the lengthwise direction of the substrate and the processor generates a scan image in which the sets of points imaged in the successive detection periods are still disposed along lines that are parallel to each other and are spaced apart by equal distances in the lengthwise direction of the scan image.

However, in practice, even in devices that are designed to employ constant-velocity linear relative displacement between an image-sensing unit and a substrate (for example, in the lengthwise direction of the substrate), the direction and magnitude of the relative displacement tends to deviate from the nominal settings, for example: because the substrate position may be skewed at an angle compared to the nominal position, because a mechanism that transports the substrate (or the sensing device) during imaging may have defects that produce variations in the direction and magnitude of the motion, and so on. Thus, the magnitude and direction of the relative motion between a substrate and an in-line sensing unit may change between successive detection periods when the sensing unit detects markings on the substrate. As a consequence, distortion can occur between the actual markings on the substrate and the markings as they appear in the scan image produced by the imaging device.

Imaging devices have been proposed that implement routines to estimate what is the actual velocity of a relative displacement that takes place between a substrate and a sensing unit of the image device, at different time points during an imaging process. Here we shall refer to the relative displacement velocity as "page velocity" irrespective of the form of the substrate (i.e. irrespective of whether the substrate takes the form of an individual sheet or page or some other form, e.g. a continuous or semi-continuous web), and irrespective of which element moves during the imaging process (i.e. irrespective of whether the substrate is transported past a stationary sensing device, whether the sensing device is moved past a stationary substrate, or whether the relative motion is produced by some combined motion of the substrate and sensing device). Estimation of page velocity may involve: estimating the direction and magnitude of a rotation in the plane of the substrate, estimating coordinates of the rotation centre of such a rotation, and estimating the velocity of translational motion (for example, estimating translational velocity in the nominal direction of the relative displacement between the sensing device and the page, and in a second direction perpendicular to the first direction).

Some page velocity estimation routines employ optical flow techniques. One step in the page velocity estimation routine may involve determining the registration between positions of pixels in the scan image and the positions on the substrate that were imaged to produce the scan image data. This step of determining the registration between the scan image and the actual markings on the substrate may involve processing the scan image data to determine how the patterns of intensities of pixels vary along different straight lines in the scan image plane and then processing a digital representation of the target image on the substrate so as to locate, in the digital representation, the positions of pixels having these same patterns of intensities. By matching the patterns of intensities, it becomes possible to determine the relationships between positions of pixels in the scan image and the corresponding points on the substrate which were imaged to generate those pixels. Estimates of the page velocity in translation and rotation may then be calculated using the determined relationships.

BRIEF DESCRIPTION OF THE DRAWINGS

Page-velocity estimation methods, printing devices and imaging devices according to some examples of the invention will now be described, by way of illustration only, with reference to the accompanying drawings.

FIG. 10 is a diagram illustrating smoothing of result data; and

DESCRIPTION OF METHODS, PRINTING DEVICES AND IMAGING DEVICES ACCORDING TO EXAMPLES OF THE INVENTION

Page velocity estimation techniques according to examples of the invention will now be described with reference to FIGS. 1 to 10. The methods of these examples will be described in a context where the methods are performed using an on-board processor in a printer that includes an in-line scanner arranged to scan patterns that the printer has printed on individual pages, as the pages are transported through the printer. However, it is to be understood that the methods of the invention may be performed in other contexts and, in particular:

- the invention is not limited to the case where the method is performed in a printer or in another apparatus having a function of printing or otherwise recording a pattern on a substrate; the method may be performed in general in any apparatus where an in-line sensing device performs line-based imaging of patterns on a substrate as a relative displacement occurs between a sensing unit of the imaging device and the substrate, for example, in a scanner or other imaging device;
- the invention is not limited to use of an on-board processor; the processor may be in a separate device that receives various signals from the apparatus that incorporates the sensing unit that images the substrate;
- the invention is not limited to the case where the substrate consists of individual pages or sheets; methods according to examples of the invention may be applied irrespective of the form the substrate takes including but not limited to: a sheet or page, a continuous or semi-continuous web, and so on, moreover the material from which the substrate is formed is not particularly limited; and
- the invention is not limited to the case where the substrate is transported relative to the sensing unit; the sensing unit may be transported relative to the substrate, or the relative displacement may result from motion both of the substrate and of the sensing unit.

Figure 1:
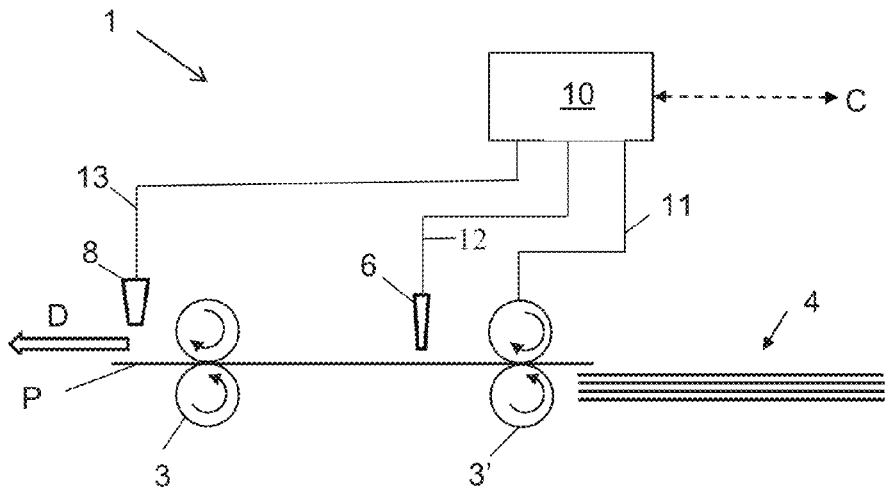
FIG. 1 is a schematic representation of a printing device that can implement page-velocity estimation methods according to examples of the invention.

FIG. 1 is a schematic representation of certain components in one example of printer 1 in which the page velocity estimation method of the present example is employed. As illustrated in FIG. 1, the printer 1 includes a page transport mechanism 3, 3' (here illustrated in a highly simplified form consisting of two pairs of rollers) for transporting individual pages P from a supply zone 4 through the printer 1. The printer 1 further includes a writing module 6 for creating markings on a page P as it is transported through a printing zone in the printer 1. The writing module 6 may use any convenient technology for creating markings on the page P including but not limited to ink jet printing, laser printing, offset printing, and so on.

In printer 1 an in-line sensing unit 8 is arranged to image the markings on a page P after that page has been transported through the printing zone and, thus, the sensing unit 8 can image markings that the writing module 6 has created on a page. However, the printer 1 can feed a page through the printing zone without the writing module 6 creating any new markings on that page and the sensing unit 8 then detects any pre-existing markings that were already present on the page P when it entered the printing zone.

In this example the in-line sensing unit 8 is a TDI unit and includes a multi-line array of contiguous sensors each line of sensors being positioned to image a line extending at least the whole width of a page P. The array may include a large number of individual sensors (e.g. of the order of thousands of individual sensors) in the case of a large-format commercial printing device. The signals from the different lines of sensors are averaged to produce image data for a line of the scan image.

The printer 1 further includes a processor 10 connected to the transport mechanism 3, 3', to the writing module 6 and to the sensing unit 8, via respective connections 11, 12 and 13. The processor 10 is arranged to control operation of the printer 1 and, in particular, to control feeding of pages through the printer 1 by the transport mechanism 3, 3', printing on pages by the writing module 6 and scanning of pages by the sensing unit 8. The processor 10 may supply printing data (based on a digital representation of a target image) to the writing module 6 via the connection 12. The writing module 6 may be arranged to create an image on the page P based on the printing data supplied by the processor 10 but the image actually created on the page P may depart from the target image due to a number of factors including, for example, defects in the writing module 6, defects in the operation of the transport mechanism 3, 3', and so on.

The processor 10 may be connected to a control unit C which supplies digital representations of target images to be printed by the printer 1. The control unit C may form part of another device including but not limited to a portable or desktop computer, a personal digital assistant, a mobile telephone, a digital camera, and so on. The processor may be arranged to print target images based on digital representations supplied from a recording medium (not shown), e.g. a disc, a flash memory, and so on.

In this example the processor 10 in printer 1 is configured to perform a number of diagnostic and/or calibration functions. In association with performance of such functions, the processor 10 may be configured to compare a scan image of a given page P with a digital representation of a target image that was intended for printing on page P. Discrepancies between the scan image and the target image may provide information enabling the processor 10 to diagnose malfunctions and/or defects in the operation of the printer 1 and may allow the processor 10 to perform control to implement remedial action (see below).

In this example the processor 10 is arranged to construct the scan image based on a number of assumptions, notably, assuming that each page P is transported through the printing zone at a constant linear velocity in a direction D parallel to the lengthwise direction of the page (this corresponds to the y direction in the plane of the page). More particularly, in this example the processor 10 is arranged to position the line images generated by the sensing unit 8 in successive detection periods at respective positions that are spaced apart from each other in the y direction (in the scan image plane) by a distance that depends on the time interval between successive detection periods and on the nominal page velocity through the printing zone. For a given time interval between successive detection periods, the nominal page velocity is set so that the line images generated for successive detection periods are positioned one pixel apart in the scan image (i.e. the nominal page velocity is set to make a continuous scan image). For example, if successive detection periods are $1/1600$ second apart the page velocity may be set to 1600 pixels per second so that the adjacent line images in the scan image may be positioned 1 pixel apart in the direction of page travel (here the y direction).

In this example, the processor 10 translates each line image produced by the sensing unit 8 in a given detection period into a line of pixels whose positions in the x direction in the scan image are based on the positions of the sensors in the sensing array.

In practice the page velocity may vary (in terms of its magnitude and/or direction) during the transport of a page P through the printer 1, for example due to a defect in the page transport mechanism 3,3'. Deviation of the page velocity from the nominal magnitude and/or direction may lead to distortion in the scan image, i.e. a loss of fidelity in the reproduction of the markings on the imaged page, because the processor 10 constructs the scan image assuming the nominal magnitude and direction of page velocity.

Figure 2:
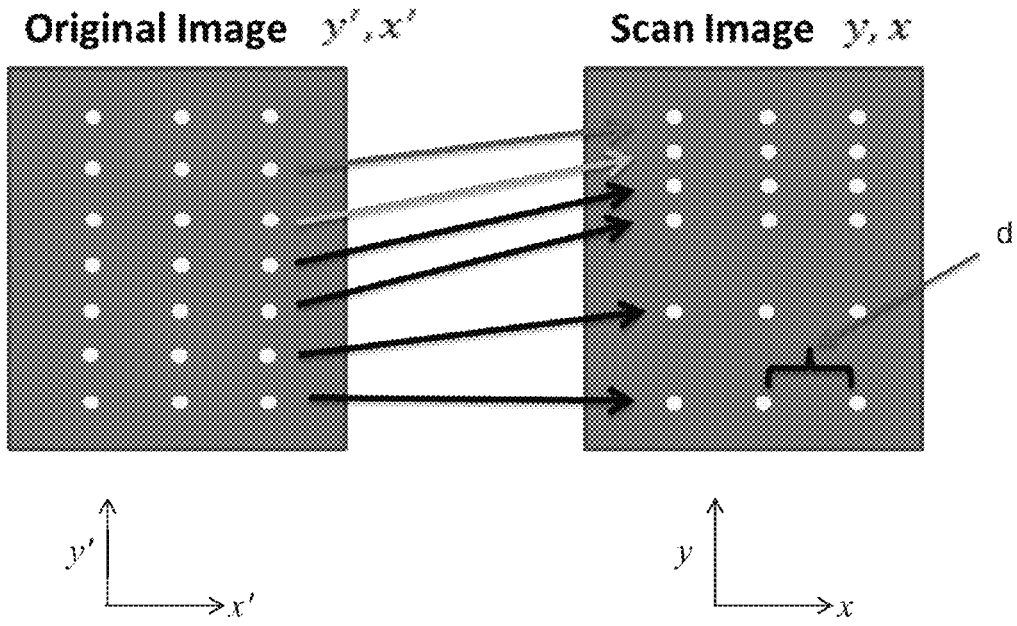
FIG. 2 is a diagram illustrating how distortion can arise between an original image and a scan image.

FIG. 2 illustrates an example of a case where distortion arises in a scan image relative to the original image on a page P imaged by the scanning unit 8 of printer 1. In the example of FIG. 2 the original image on the page P includes dots arranged in rows across the page width, the rows are parallel to each other and the spacing between rows is uniform. However, the page velocity varies as the page P is transported past the sensing unit 8 of printer 1 so that the scan image does not faithfully reproduce the positions of the dots as in the original image. In this example, the scan image still shows rows of dots extending across the page width but the spacing between the rows is no longer uniform. In this example the spacing d between dots in the same line of the scan image (i.e. dots imaged during the same detection period) depends on the spacing between the individual sensors in the in-line sensing unit 8.

Scanning artefacts and noise may affect the output of the in-line sensing unit 8, especially if a low-cost sensing unit is employed. Accordingly, when the processor 10 seeks to compare the scan image to a digital representation of the target image that was supposed to be created on the page P it may not be possible for the processor 10 to detect print defects accurately. Furthermore, scanning artefacts and noise of this kind cause problems if the processor 10 implements a page-velocity estimation method which includes a step of determining the registration between pixels in the scan image and positions in the target image based on detecting in the target image a line of pixels having the same pattern of intensities as a given line of pixels in the scan image. In such a case, the processor 10 may not be able to find a match in the reference image to the pixel intensities occurring along a line in the scan image. Further, in such a case the processor 10 may increase the size of the region in the scan image that is used in the estimation process but this leads to a loss in precision of the velocity estimate.

In the present example, the printer 1 is operable in a page-velocity estimation mode in which the processor 10 implements a page velocity estimation method that makes use of a reference pattern 20 to enable an estimate to be made of the relative velocity of the page relative to the scanning unit 8 during the imaging process. The page velocity estimation mode may be set explicitly for the printer 1, for example by a user operating a control element (not shown), or selecting a menu option, provided for this purpose on the printer 1. Alternatively, the printer may be arranged to enter page velocity estimation mode in some other manner, for example automatically when the printer implements a calibration method or diagnostic method.

According to the page-velocity estimation method of this example, a page bearing a reference pattern 20 is transported past the in-line sensing unit 8 of the printer 1: the reference pattern may be a pre-existing pattern that is already present on the page P when the page enters the printing zone, or the processor may be arranged to control the writing module 6 to print the reference pattern 20 on a blank page based on a digital representation of the reference pattern. In any event, the processor 10 is supplied with a digital representation of the reference pattern 20 used in page-velocity estimation mode.

Figure 3A:
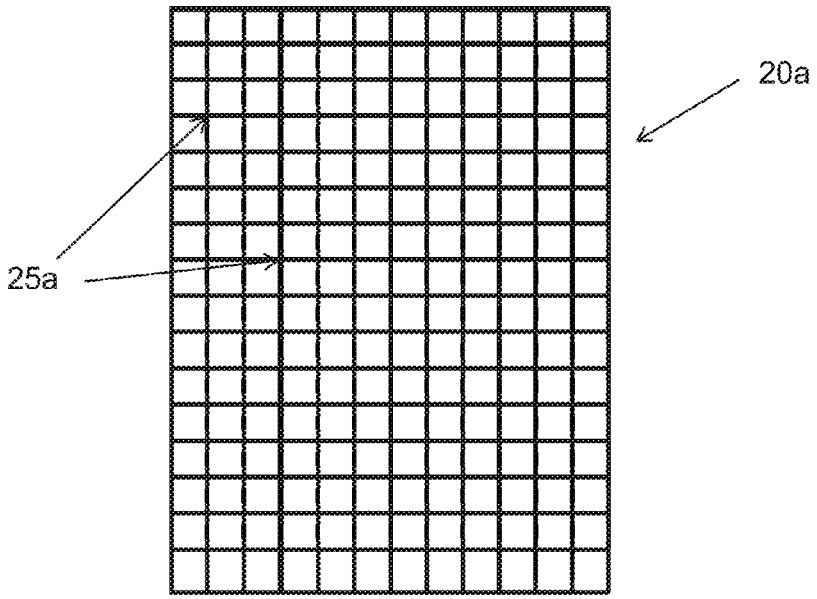
FIG. 3A shows a first example of a reference pattern that may be used in a page-velocity estimation method according to an example of the invention.

The in-line sensing unit 8 images the reference pattern 20 as the page is transported through the printer 1 and the processor 10 is arranged to produce an estimate of page velocity by processing image data generated by the sensing unit 8 and a digital representation of the reference pattern that was imaged to produce the image data. The reference pattern may be a grid pattern 20*a* as illustrated in FIG. 3A, formed by plural lines that extend parallel to the page length direction and intersect plural lines extending in the page width direction, the intersecting lines being perpendicular to each other. Other forms of reference pattern may be used, as discussed below.

Figure 4:
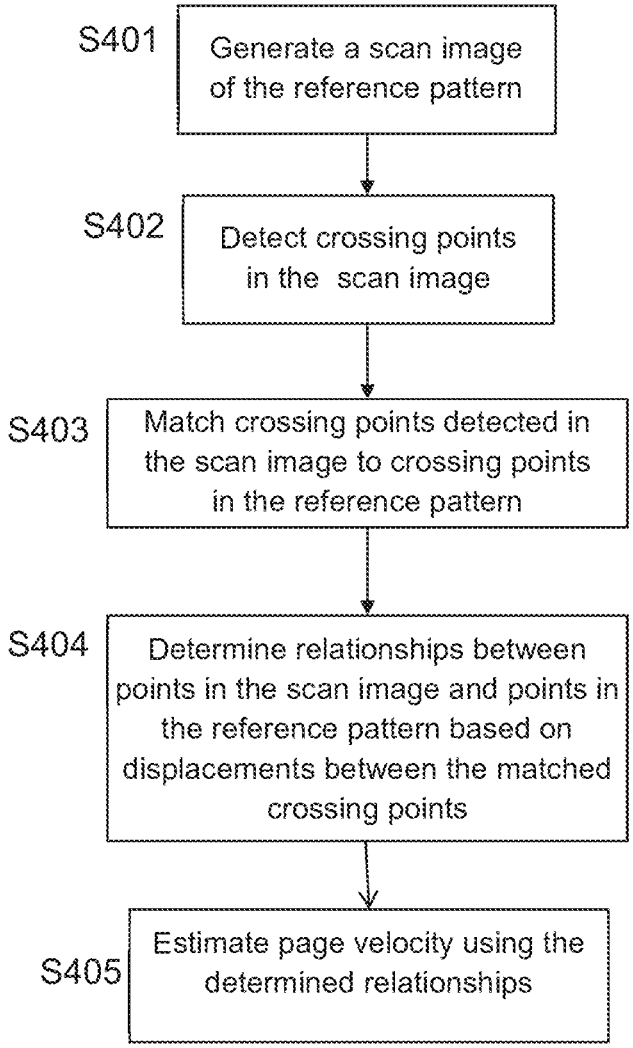
FIG. 4 is a flow diagram illustrating a page-velocity estimation method according to an example of the invention.

FIG. 4 is a flow diagram illustrating steps in one example of page-velocity estimation method according to the invention. In step S401 of the method, the processor 10 generates a scan image of the reference pattern imaged by the sensing unit 8. In step S402 of the method the processor 10 implements processing of the scan image data to detect positions of crossing points in the scan image, that is, the positions in the scan image plane of points where perpendicular lines intersect. In step S403 of the method, the processor 10 implements processing to match specific crossing points that have been detected in the scan image to crossing points in a digital representation of the reference pattern. In step S404 of the method, the processor 10 performs processing to determine relationships between positions of given crossing points in the scan image and the positions of matched crossing points in the reference pattern. Step S404 amounts to determining the registration between pixels in the scan image and the points on the page bearing the reference pattern that were imaged to generate these pixels in the scan image. In step S405 of the method, the processor 10 implements processing to determine the page velocity using the relationships/registration information generated in step S404.

According to this example, page velocity is estimated in a method which involves determining the registration between pixels in the scan image and points on the imaged substrate by finding points in the scan image where perpendicular lines cross each other and matching the locations of these detected crossing points to positions of crossing points in a reference image. Crossing points of this kind have characteristic features and it is possible to find the locations of such crossing points in the scan image accurately even in cases where the scan image is produced by a low-cost scanner having a relatively low signal-to-noise ratio. Accordingly, the page-velocity estimation method of this example produces accurate page velocity estimates even when low-cost scanning units are used to produce the scan image, thus enabling more reliable page transportation estimation, scanner calibration and image registration.

The reference pattern 20*a* illustrated in FIG. 3A includes crossing points 25*a* at positions where perpendicular lines cross each other in a regular, two-dimensional, rectilinear grid. However, the present example method is not limited to the case where the gridlines of the reference pattern define square cells: they may define rectangular cells (although this may limit the rotational angle that can be detected). Furthermore, the reference pattern does not have to include crossing points that connect to each other to form a grid. Thus, as illustrated in the example of FIG. 3B, the present method may employ a reference pattern 20*b* comprising plural crosses 25*b*, each cross 25*b* being formed by a pair of perpendicular line portions that intersect each other.

Figure 3B:
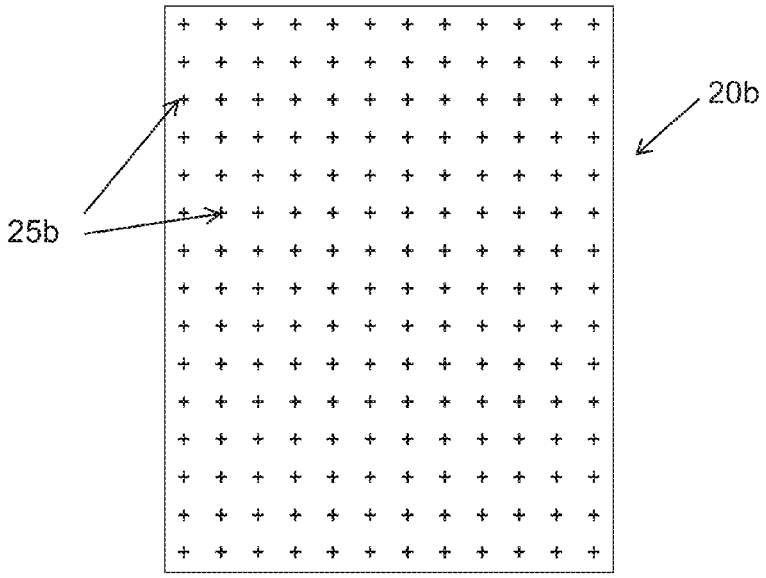
FIG. 3B shows a second example of a reference pattern that may be used in a page-velocity estimation method according to an example of the invention.
Figure 3C:
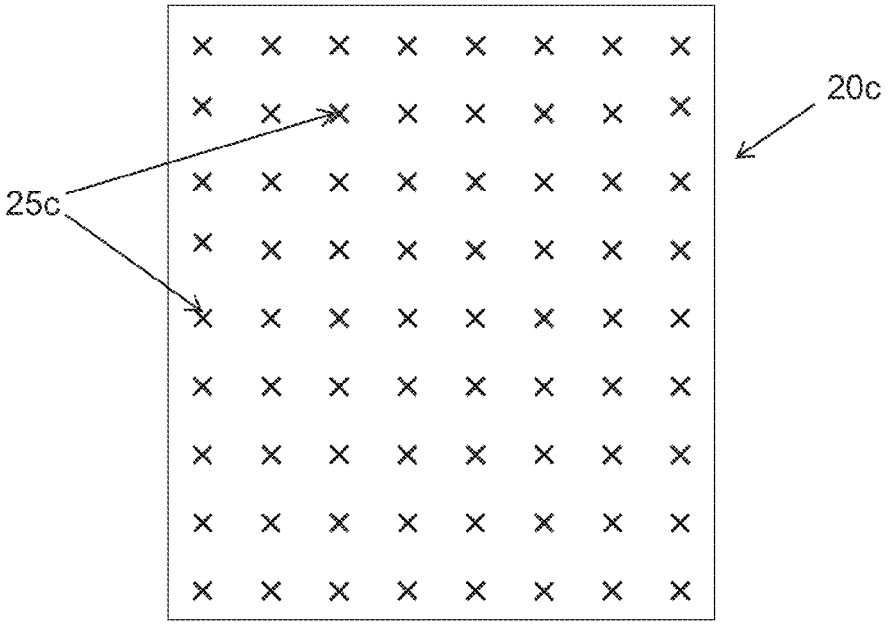
FIG. 3C shows a third example of a reference pattern that may be used in a page-velocity estimation method according to an example of the invention.

The reference patterns 20*a* and 20*b* illustrated in FIGS. 3A and 3B include crossing points 25*a*, 25*b* formed from perpendicular lines that extend in the lengthwise and widthwise directions of the page, respectively. However, the present example method is not limited to the case where the perpendicular lines extend in the lengthwise and widthwise direction of the page. Thus, as illustrated in the example of FIG. 3C, the present method may employ a reference pattern 20*c* in which the crossing points 25*c* are formed from perpendicular lines that are oriented at an angle relative to the lengthwise and widthwise directions of the page.

Reference patterns using other dispositions of crossing points may also be used in the present example page-velocity estimation method, provided that such reference patterns include plural crossing points each formed of intersecting perpendicular lines.

It is possible to apply certain methods according to the invention using a reference pattern 20 whose size is not as large as the size of the pages that are usually handled by the printing device 1. However, the accuracy of the page-velocity estimates obtained using such a reference pattern may not be as good as page velocity estimates obtained using larger reference patterns. When the reference pattern is at least as large as the pages that are usually handled by the printing device 1 there is an increased likelihood that an accurate assessment will be made of the relationship between the reference pattern and the scan image (bearing in mind that this relationship may be described by a polynomial function of unknown order).

Methods according to examples of the invention may employ different reference patterns having crossing points formed from line portions of different sizes and/or having crossing points that are spaced relatively closer or further apart from each other. When the reference pattern includes numerous crossing points spaced close to one another this tends to improve the accuracy of detection of deviations of the page velocity from the nominal value. When the component elements in the reference pattern are physically small it is possible to include a relatively large number of these components in a small space. Crossing points can be formed small in the reference pattern and yet they are highly detectible: a cross pattern gives high measurement accuracy (in the directions corresponding to the constituent line portions) as a function of the dimensions of those line portions.

The maximum permissible distance between crossing points in the reference pattern depends on the nominal page velocity and the period of time over which it is desired to detect velocity changes. The minimum permissible distance between crossing points in the reference patterns may be set based on the size of convolution kernels that may be used for detection of crossing points in a scan image of the reference pattern produced by the sensing unit (see below). In an example of the method wherein nominal page velocity was 1600 pixels per second it was found that the accuracy of the page velocity estimates improved when both the lengths of the line portions corresponding to the convolution kernels and the minimum spacing between neighbouring crossing points in the reference pattern were 50 pixels or greater.

One example of a method the processor 10 may implement to perform step S402 of FIG. 4 to determine the locations, in the scan image, of places where perpendicular lines cross each other will now be described. An overview of the example method will be given before discussing steps therein with reference to the flow diagram of FIG. 5.

In this example method for determining locations of crossing points the processor 10 first computes convolution products. More particularly, the processor 10 computes a given convolution product by first convolving the scan image with a first kernel (that corresponds to a first straight line portion) to produce a first convolution result, then convolving the scan image with a second kernel (that corresponds to a second straight line portion perpendicular to the first straight line portion) to produce a second convolution result, and then multiplying the first and second convolution results to produce a convolution product. The convolution product contains peaks of intensity at locations in the scan image plane that correspond to crossing points that are formed from line portions oriented in the same directions as the first and second straight line portions of the convolution kernels. In particular, each peak of intensity coincides with the point of intersection of the lines forming a crossing point. The processor 10 may be arranged to detect the locations, in the scan image plane, of the centres of these intensity peaks and to register these locations as the centres of crossing points in the scan image.

The above-described example method, which multiplies the results of respective convolution processes that use kernels corresponding to perpendicular lines, is particularly fast. Moreover, this method based on multiplication of the results of the convolution processes produces strong and accurate peaks corresponding to the points of intersection in the crossing points and these peaks stand out relative to local noise, even noise of the degree associated with relatively cheap scanning devices.

When the processor 10 performs the example method to determine locations of crossing points in a scan image of a reference pattern of the types illustrated in FIGS. 3A and 3B, where each crossing point is formed from line portions that extend in the page length and page width directions, it may be expected that the scan image will contain crossing points formed from line portions that extend in the vertical and horizontal directions in the plane of the scan image (assuming that the page bearing the reference pattern travelled past the scanning unit 8 in the lengthwise or widthwise direction of the page). Thus, the locations of the crossing points may be found in the scan image using convolution kernels that correspond to straight line portions oriented in the vertical and horizontal directions in the scan image plane.

In a similar way, when the processor 10 performs the example method to determine locations of crossing points in a scan image of a reference pattern of the type illustrated in FIG. 3C, where each crossing point is formed from line portions that extend in the left and right diagonal directions of the page, it may be expected that the scan image will contain crossing points formed from line portions that extend in the left and right diagonal directions (assuming that the page bearing the reference pattern travelled past the scanning unit 8 in the lengthwise or widthwise direction of the page). Thus, the locations of the crossing points may be found in the scan image using convolution kernels that correspond to straight line portions oriented in the left and right diagonal directions in the scan image plane.

Now, during the imaging process the page carrying the reference pattern may have been skewed at an angle relative to the nominal page orientation. With this issue of skew in mind, the processor 10 may be arranged to compute plural convolution products for a given scan image, and in the computation of each convolution product the processor may employ kernels that correspond to first and second straight line portions that are in a slightly different orientation in the scan image plane as compared to the orientations used in the computations of the other convolution products (whilst still being perpendicular to each other). The processor 10 may then be arranged to identify which of the convolution products contains peaks of maximum intensity (that is, peaks of intensity greater than that of peaks in the other convolution products). The identified convolution product should correspond to the case where the orientations of the straight line portions of the convolution kernels best match with the orientations of the lines forming the crossing points in the scan image and, thus, the orientation of the straight line portions in these convolution kernels provides the processor 10 with information regarding the likely skew angle of the page bearing the reference pattern as that page was transported relative to the scanning unit 8.

In a case where the processor 10 is arranged to compute plural convolution products for a given scan image, the kernels used in the different computations may correspond to different orientations of the cross-shaped mask, one orientation corresponding to the orientation of crossing points in the scan image assuming that the imaged page was in the nominal orientation during imaging, and other orientations of the mask corresponding to a range of skew angles on either side of the nominal page orientation (e.g. covering a skew of ±2.5 degrees either side of the nominal page direction, for example in steps of 0.5 degrees).

In a case where the processor 10 is arranged to compute plural convolution products for a given scan image, and to identify the convolution product that has maximum intensity peaks, the processor 10 may be arranged not only to determine page skew based on the identified maximum-peak-intensity convolution product but also to identify the locations of crossing points in the scan image by processing the identified maximum-peak-intensity convolution product preferentially rather than processing other convolution products. This improves the accuracy of the crossing-point locations determined by the professor 10.

The specific example method for determining locations of crossing points according to FIG. 5 will now be described. In this specific example the processor 10 is arranged to compute plural convolution products for a given scan image produced by imaging a reference pattern. In step S501 of the FIG. 5 the processor 10 sets an angle $\alpha$ to an initial value that is designated here as $\alpha_0$, and sets a counting variable k to 0. In step S502 of this example the processor 10 performs a convolution between the scan image data and a kernel that corresponds to a line segment oriented at angle $\alpha$ relative to the vertical in the scan image, producing a result designated CIvk. In step S503 of this example method the processor 10 next performs a convolution between the scan image data and a kernel that corresponds to a line segment oriented at angle $\alpha$+90° relative to the vertical in the scan image, producing a result designated CIhk. It will be understood that the line segments used in the convolutions of steps S502 and S503 are perpendicular to each other. In step S504 of the example method the processor 10 multiplies together the results of the convolution processes of steps S502 and S503 to give a product designated Pk.

Figure 5:
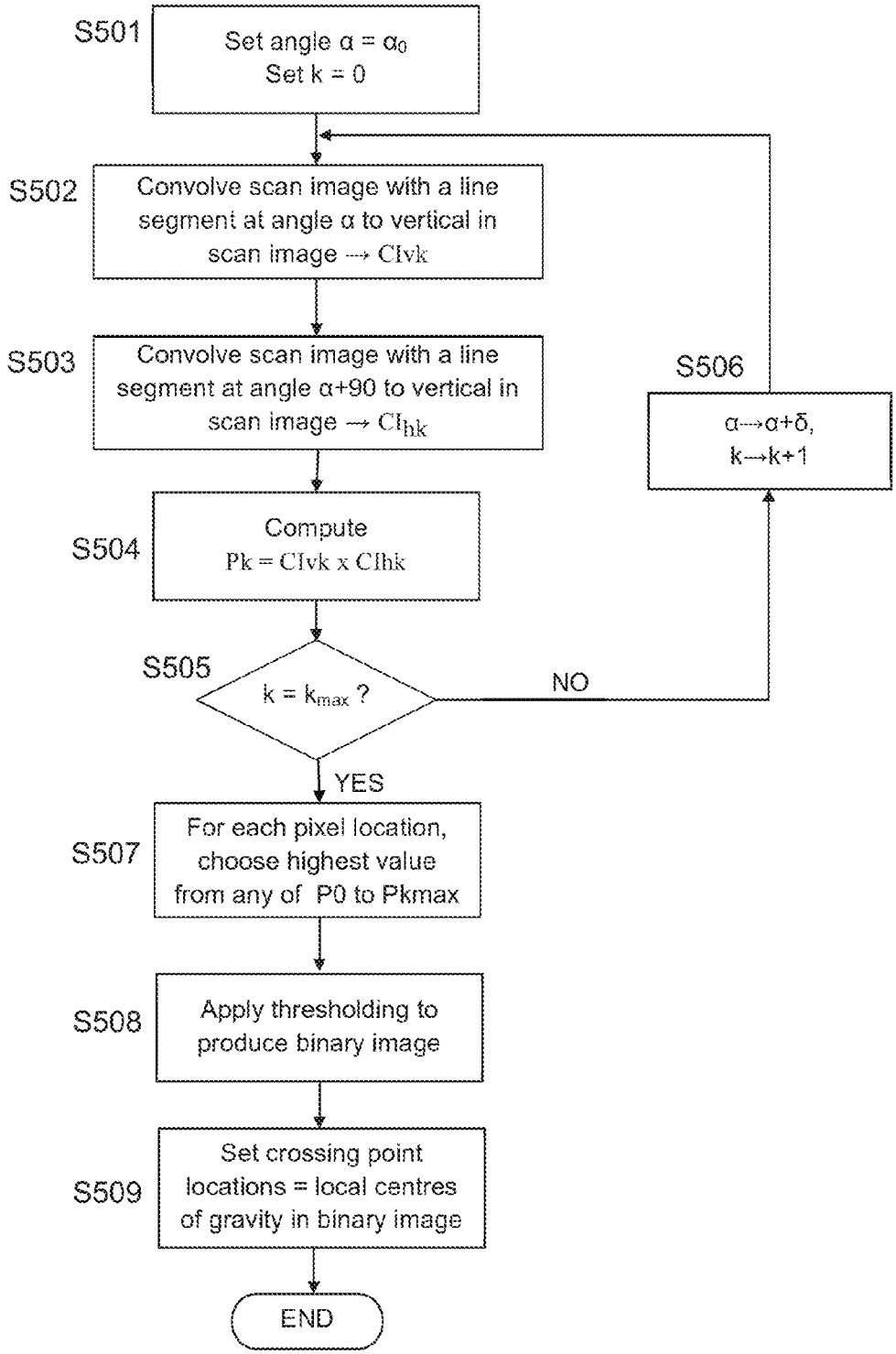
FIG. 5 is a flow diagram illustrating an example of a crossing-point detection process that may be used in the method of FIG. 4.

Next, in step S505 of FIG. 5 the processor 10 checks whether the counting variable k has reached a predetermined maximum value $k_{max}$. If the counting variable k has not yet reached the maximum value then the processor increments the counting variable k by 1 and increases angle $\alpha$ by an increment $\delta$ (step S506 of FIG. 5) then repeats the steps S502 to S505. It will be understood that the incrementing of the count variable k allows the orientation of the line segment used in the convolution process of step S502 to be gradually shifted from $\alpha_0$ to $\alpha_0+(\delta\times k_{max})$, in steps of $\delta$ degrees. Likewise, the orientation of the line segment used in the convolution process of step S503 gradually shifts from ($\alpha_0$+90°) to ($\alpha_0+(\delta\times k_{max})$+90°), in steps of $\delta$ degrees. The values of $\alpha_0$, $\delta$ and $k_{max}$ may be chosen to ensure that convolution products are computed using kernels that correspond to a cross-shaped mask oriented according to the nominal orientation of the scanned page as well as using kernels that correspond to page orientations covering a range of values either side of the nominal orientation.

If in step S505 of the FIG. 5 method the processor 10 determines that the counting variable k has reached the predetermined maximum value $k_{max}$ then the processor 10 executes processing to locate the maximum intensity peaks in the various convolution products that have been computed (step S507 in FIG. 5). To do this, the processor 10 finds, for each pixel location in the scan image plane, the maximum value of signal intensity at this location out of any of the convolution products. This amounts to generating a synthetic image with the intensity value of each pixel of the synthetic image set to the maximum value observed at this pixel location in any of the convolution products. The processor 10 then proceeds to determine the locations of crossing points in the scan image by determining the centres of the intensity peaks in the synthetic image. Various techniques may be used for determining the locations of the centres of the intensity peaks in the synthetic image.

Steps S508 and S509 of FIG. 5 illustrate one example of a technique that may be used for determining the locations of the centres of the intensity peaks in the synthetic image. In step S508 the processor 10 converts the two-dimensional synthetic image data into a binary image, i.e. an image in which each pixel takes one of only two values (corresponding either to black or white). A convenient technique for performing the conversion to a binary image consists in defining a local threshold value and assigning black or white values to pixels of the synthetic image depending on whether or not their value exceeds the local threshold value (step S508 in FIG. 5). In the present example, for a pixel at a given location in the synthetic image, the threshold value $\theta$ may be set to correspond to:

$$\theta=\mu+2\sigma$$

where $\mu$ is the mean value taken by the pixels in a small area local to the subject pixel, and $\sigma$ is the standard deviation of the values taken by the pixels in this small area local to the subject pixel. This amounts to searching in the synthetic image for local maxima. In the present example, a pixel in the synthetic image is converted to a white pixel in the binary image if the intensity of this pixel in the synthetic image is greater than $\theta$, otherwise the pixel is converted to a black pixel in the binary image. The binary image produced by this technique contains regions where white pixels are connected together in blob-shaped regions, on a black background. In the method according to the present example, where the binary image contains blob-shaped regions where white pixels are connected together, a list of the connected pixels can be generated in a simple manner by making use of a function designated "bwlabel" provided in the numerical programming environment MATLAB developed by The MathWorks Inc.

In step S509 of FIG. 5, the processor 10 determines the positions of local centres of gravity of the different connected-white-pixel regions in the binary image, and labels the position of each centre of gravity as the position of a respective crossing point in the scan image.

The example crossing point location technique illustrated by FIG. 5 makes it possible to determine to sub-pixel precision the locations of crossing points in the scan image plane. Other crossing-point detection methods may be used to implement step S402 of FIG. 4. For example a variant of the FIG. 5 method could be used in which the synthetic image is not converted to a binary image before detection of the centre-points of the intensity peaks. However, a variant of that kind would not detect crossing point locations with sub-pixel accuracy.

At the end of execution of the example method illustrated by FIG. 5, the processor 10 has data identifying the locations in the scan image plane of a number of crossing points. However, the processor 10 does not yet know how these crossing points in the scan image relate to the individual crossing points in the reference pattern. According to the example page-velocity estimation method of FIG. 4, the processor 10 performs a matching process to determine one-to-one relationships between crossing points identified in the scan image and crossing points present in the reference pattern that has been imaged to produce the scan image. A digital representation of the reference pattern is available to the processor 10

One example of a method for matching crossing points in the scan image to crossing points in the reference pattern will now be described with reference to FIG. 6. In this example method the processor 10 implements a recursive search procedure in which a crossing point C(n,m) in the scan image that has already been matched to a crossing point (n,m) in the reference pattern serves as a jumping off point for defining a search region in the scan image where the processor will look for a neighbouring crossing point, notably where the processor will look for a crossing point corresponding to (n+1,m) or (n,m+1) in the reference pattern. In this example it is assumed that the page bearing the reference pattern was supposed to move in the page-length direction relative to the sensing unit during the imaging process.

Figure 6:
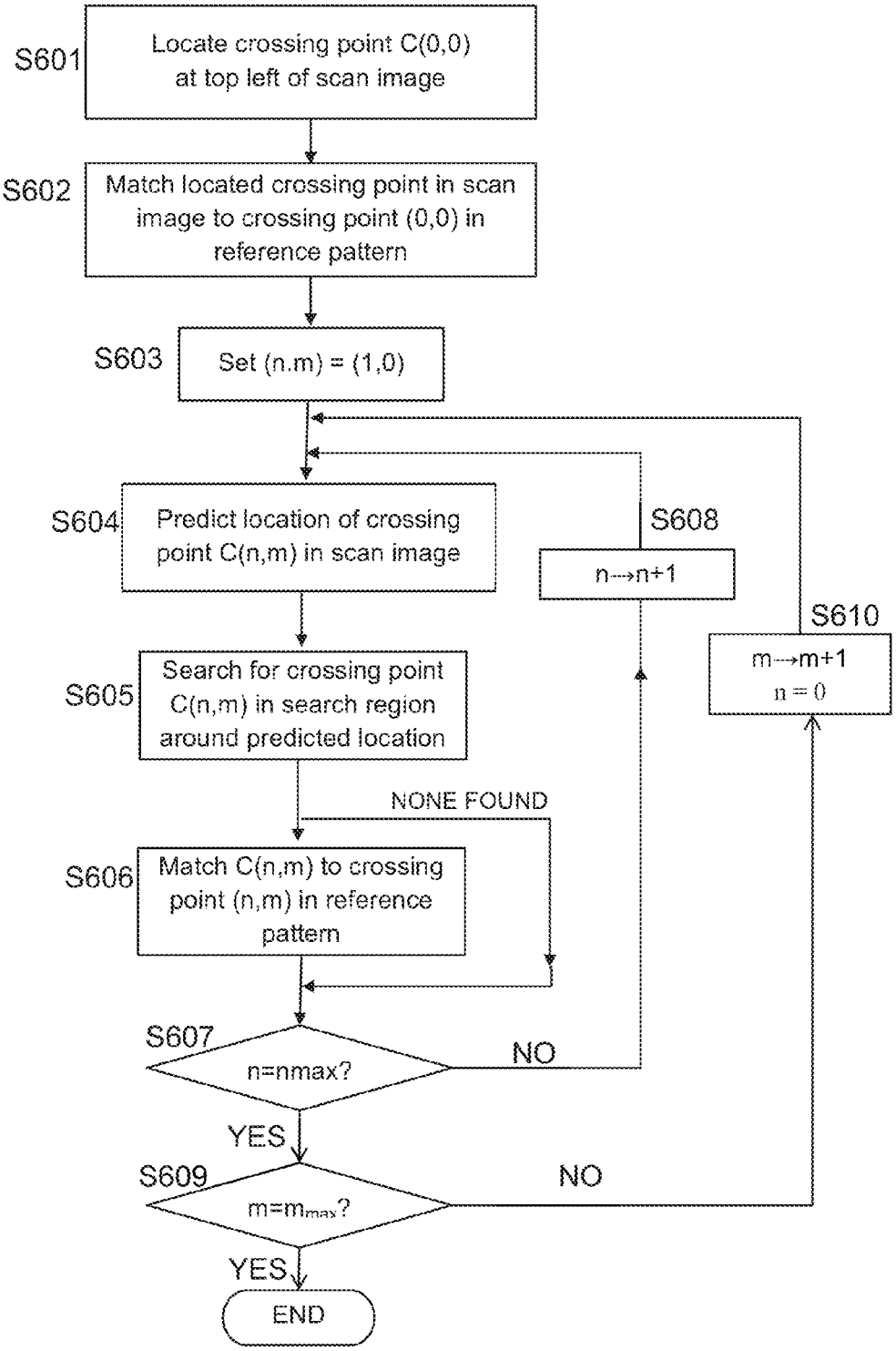
FIG. 6 is a flow diagram illustrating an example of a crossing-point matching process that may be used in the method of FIG. 4.

According to the example method illustrated in FIG. 6, in a first step S601 the processor 10 locates, in the scan image, the crossing point that is located closest to the top left-hand corner of the scan image plane. This crossing point shall be designated C(0,0). The processor is configured to assume that crossing point C(0,0) in the scan image is an image of a crossing point (0,0) that is located at the top left-hand corner in the reference pattern. Thus, in step S602 of the FIG. 6 method the processor registers crossing point C(0,0) in the scan image as a match to crossing point (0,0) in the reference pattern.

It is to be understood that the choice of a crossing point location at the top left-hand corner of the scan image is non-limiting; a different start point could be chosen for the recursive search procedure as long as the selected start point enables a crossing point in the scan image to be matched unambiguously to a crossing point in the reference pattern. Thus, for example, the recursive search procedure could start by matching the crossing point closest to the top-right corner, bottom-left corner or bottom-right corner of the scan image to the crossing point in the corresponding corner of the reference pattern. In the example of FIG. 6 the start point for the recursive matching procedure is the top-left corner of the image and the crossing point at this location in the reference pattern is designated (0,0). In this example, each crossing point in the reference pattern may be identified by coordinates (n,m) where n is an index that increases in the direction from left to right across the page and m is an index that increases in the direction from top to bottom of the page. A crossing point in the scan image that has been matched to the crossing point (n,m) in the reference pattern shall be designated C(n,m).

Returning to the example illustrated in FIG. 6, in step S603 the processor 10 sets coordinates (n,m) to the value (1,0); this defines a crossing point (1,0) in the reference pattern as a target for which the processor 10 will now look for a match in the scan image. It will be noted that the crossing point (1,0) in the reference pattern, which is the next target for matching, is one of the nearest neighbours of the crossing point (0,0) in the reference image which was matched in the preceding step of the method.

In step S604 of FIG. 6 the processor 10 predicts the location of a crossing point C(1,0) in the scan image that should correspond to the target crossing point (1,0) in the reference pattern. The predicted position of C(1,0) in the scan image plane is computed based on the location of the crossing point C(0,0) in the scan image plane and the known spacing between crossing points in the reference pattern. However, distortion in the scan image (due to factors such as page-velocity deviations and skew of the substrate) means that the image of crossing point (1,0) of the reference pattern may well not occur at the predicted location in the scan image plane. Accordingly, in step S605 the processor defines a search region centred on the predicted position of C(1,0) and checks whether any of the crossing points that have been identified in the scan image occur within this search region. In this example, assuming that neighbouring crossing points in the reference pattern are spaced apart by a distance $d_N$ in the direction of increasing n value and are spaced apart by a distance $d_M$ in the direction of increasing m value, the size of the search region is $d_N$ by $d_M$, centred on the predicted location of C(1,0).

If, in step S605, the processor 10 determines that the search region contains one of the crossing points that has been detected in the scan image then this crossing point in the scan image is registered as C(1,0), i.e. it is matched to the crossing point (1,0) in the reference pattern. On the other hand, if no crossing point is found in the search region of the scan image then no match is assigned to the crossing point C(1,0) of the reference pattern. If more than one crossing point is detected in the scan image within the search region then any suitable algorithm may be employed to select one of these crossing points to match to the target crossing point in the reference pattern. For example, the crossing point closest to the centre of the search region may be selected.

The processor moves on to check, in step S607, whether the value of n has reached a maximum value $n_{max}$, i.e. the processor checks whether the matching process has reached the right-hand edge of the page/image.

If the processor finds in step S607 that $n \neq n_{max}$ then the value of n is increased by one in step S608 and the flow returns to step S604 so that the processor can search for a crossing point in the scan image that matches to the next crossing point to the right. On the other hand, if the processor finds in step S607 that n has reached $n_{max}$ then a check is made in step S609 whether the value of m has reached a maximum value $m_{max}$, i.e. the processor checks whether the matching process has reached the bottom of the page/image.

If the processor finds in step S609 that $m \neq m_{max}$ then the value of m is increased by one in step S610—so that the processor can search for a crossing point in the scan image that matches to a crossing point in the next row down the reference pattern—and the value of n is re-set to 0 so that the processor will search for a crossing point in the scan image that matches to the left-hand crossing point in this next row down the reference pattern.

The processor continues implementing the loops S604-S609 via S608 and S610 to perform the recursive search process systematically searching for crossing points in the scan image that match to the crossing points positioned left-to-right in the rows of the reference pattern and in the different rows from top-to-bottom of the reference pattern. (The search directions may be modified if the start point of the matching process is not the top left-hand corner.) After the processor 10 has searched for a match for crossing point $(n_{max},m_{max})$ of the reference pattern the results of steps S607 and S609 of FIG. 6 will both be "yes" and the matching process comes to an end. By this time the processor has generated a list of crossing points in the scan image that match to respective specific crossing points in the reference pattern.

It has been found that the matching technique of FIG. 6 enables crossing points in the scan image to be reliably matched to crossing points in the reference pattern even in cases where the substrate bearing the reference pattern was skewed, during the imaging process, by skew angles of up to 40° relative to the nominal direction.

The differences between the location of a given crossing point in the reference pattern and the location of the matched crossing point in the scan image can arise due to various deviations of the page velocity from the nominal setting during the imaging process. In particular, the page may have undergone translational motion in one or both of orthogonal x and y directions, it may have undergone a rotation around a rotation centre $(x_0,y_0)$, and it may have started out skewed relative to the nominal page orientation. Moreover, the direction and magnitude of page velocity may vary in a dynamic manner as the imaging process progresses.

The differences between the locations of crossing points in the scan image plane and the locations of the matched crossing points in the reference pattern plane encode information regarding how the page velocity has varied during the imaging process. Now, by applying the methods described above the locations of the crossing points in the scan image according to the coordinate system of the scan image plane can be determined, and the locations of the crossing points in the reference pattern according to the coordinate system of the reference pattern are already known (from the digital representation of the reference pattern). Accordingly, by suitable processing the processor 10 can extract information regarding how the page velocity has varied during the imaging process from the relationships between the locations of crossing points in the scan image plane and the locations of the matched crossing points in the reference pattern plane.

An example of how the processor 10 may determine relationships between pixels in the scan image and points in the reference pattern that were imaged to generate the points in the scan image, implementing step S404 of FIG. 4, shall now be described. In the present example the processor 10 is arranged to calculate non-linear transformation parameters relating the crossing points' locations in the scan image to their locations in the reference pattern. The non-linear transformation parameters are calculated making use of the relative spatial positions of the matched crossing points in the scanned and reference images.

A displacement between a given crossing point in the reference pattern and the matched crossing point in the scan image can arise from a combination of different translational and rotational movements. For example, a point (y,x) in the reference pattern may be shifted to a location (y',x') in the scan image by either of the following:

- a first rotation of the page around a centre of rotation (a,b) by a first angle, or
- a translation of the page in a first direction, followed by a different rotation of the page around a centre of rotation (c,d).

Moreover, in principle a movement caused by a translation followed by a rotation does not produce the same displacement as a rotation followed by a translation. Accordingly, a strategy is needed in order to be able to disentangle rotational and translational movements of the page.

According to an example of a computation procedure employed in the invention, the calculations applied by the processor 10 are based on certain assumptions. Firstly, it is assumed that for small areas in the reference pattern and scan image:

- all the points in the small area are imaged at approximately the same time so that the displacement of a point in this small area that results from a translation followed by a rotation is approximately the same as the displacement the point experiences resulting from a rotation followed by a translation,
- the orientation angle of the page is constant when the small area is imaged (i.e. any rotation of the page during imaging of the small area is a rotation through a small angle, such that the sine of the angle approximates to the angle itself and the cosine of the angle approximates to 1),
- points in the small area that are at different positions in the x-direction (perpendicular to the nominal direction of page advance) are sufficiently close together that they are imaged by the in-line sensing unit 8 during a common detection interval and, thus, the page velocity is the same when all these points were imaged, points in the small area that are at different positions in the y-direction (parallel to the nominal direction of page advance) are sufficiently close together that they are imaged by the in-line sensing unit 8 during detection intervals that are close together in time and, thus, the page velocity is approximately the same when all these points were imaged, and thus it can be assumed that the page velocity is constant during imaging of the small area.

Secondly, it is assumed that displacement of the page P is displacement of a rigid body, i.e. it is assumed that the dimensions of the page do not change during the imaging process (any potential folding or kinking of the page is disregarded).

The foregoing assumptions give rise to relations (1) and (2) indicating how the coordinates (x',y') of a point in the reference pattern relate to the coordinates (x,y) of the image of that point in the scan image plane:

$$y'=y+(x-x_0)(wt+Ø)+v_y t+y_c \tag{1}$$

$$x'=(y-y_0)(-wt-Ø)+x+v_x t+x_c \tag{2}$$

where the point in question is imaged at a time t, $(x_0,y_0)$ are the coordinates in the scan image plane of the centre of rotation of rotational movement at time t, w is the page's rotational velocity at time t, $v_y$ is the page's translational velocity in the y direction at time t, $v_x$ is the page's translational velocity in the x direction at time $t_1$, $x_c$ is the shift in the x-direction of the point's position between the reference pattern and the scan image, $y_c$ is the shift in the y-direction of the point's position between the reference pattern and the scan image, and Ø is the rotational angle, that is the angle of the page at time t (relative to the nominal page orientation).

The processor is arranged to generate the scan image by positioning a line of image data generated by the sensing unit 8 at a y-coordinate in the scan image plane that is proportional to the time t at which this line of data was detected, i.e. t=yc, where c is a proportionality constant related to the nominal magnitude of page velocity (assuming y corresponds to the nominal direction of page advance).

Thus, the variable t in relations (1) and (2) can be replaced by cy, so relations (1) and (2) may be transformed to relations (3) and (4) below:

$$y'=y+(x-x_0)Ø+(x-x_0)wyc+v_y yc+y_c \tag{3}$$

$$x'=(y-y_0)(-Ø)+(y-y_0)(-wyc)+x+v_x yc+x_c \tag{4}$$

Grouping together the terms in relations (3) and (4) that relate to the parameters x and y, relations (3) and (4) can be rewritten as relations (5) and (6) below $$y'=cwyx+(1-cwx_0+cv_y)y+Øx+(Øx_0+y_c) \tag{5}$$

$$x'=-cwy^2+(-Ø+cv_x+cwy_0)y+x+(Øy_0+x_c) \tag{6}$$

and using symbols a1 to a8 to replace the coefficients of the different terms in relations (5) and (6), relations (5) and (6) can be rewritten as relations (7) and (8) below:

$$y'=a1yx+a2y+a3x+a4 \tag{7}$$

$$x'=a5y^2+a6y+a7x+a8 \tag{8}$$

Now, when the processor 10 has a list of n matched crossing points in the scan image plane and in the reference pattern the coordinates of these crossing points in the scan image plane may be designated $(x_1,y_1)$, $(x_2,y_2)$, $(x_3,y_3)$, . . . , $(x_n,y_n)$, and the coordinates of the matched crossing points in the reference pattern plane may be designated $(x'_1,y'_1)$, $(x'_2,y'_2)$, $(x'_3,y'_3)$, . . . , $(x'_n,y'_n)$. Substituting the coordinate values of the matched crossing points into relations (7) and (8) yields relations (9) and (10) below:

$$(y'_1, y'_2, y'_3, \ldots, y'_n) = (a1\ a2\ a3\ a4)\begin{pmatrix} xy_1 & xy_2 & xy_3 & \ldots xy_n \\ y_1 & y_2 & y_3 & \ldots y_n \\ x_1 & x_2 & x_3 & \ldots x_n \\ 1 & 1 & 1 & 1 \end{pmatrix} \tag{9}$$

$$(x'_1, x'_2, x'_3, \ldots, x'_n) = (a5\ a6\ a7\ a8)\begin{pmatrix} y_1^2 & y_2^2 & y_3^2 & \ldots y_n^2 \\ y_1 & y_2 & y_3 & \ldots y_n \\ x_1 & x_2 & x_3 & \ldots x_n \\ 1 & 1 & 1 & 1 \end{pmatrix} \tag{10}$$

However, a comparison of relations (5) and (7) above with relations (6) and (8) shows that a1=−a5. Taking this fact into account, relations (9) and (10) can be combined into relation (11) below.

$$(y'_1, y'_2, y'_3 \ldots, y'_n, x'_1, x'_2, x'_3 \ldots, x'_n) = (a1\ \ a2\ a6\ a3\ a7\ a4\ \ a8) \tag{11}$$

$$\begin{pmatrix} xy_1 & xy_2 & xy_3 & \ldots xy_n & -y_1^2 & -y_2^2 & -y_3^2 & \ldots -y_n^2 \\ y^1 & y^2 & y^3 & \ldots y_n & 0 & 0 & 0 & \ldots 0 \\ 0 & 0 & 0 & \ldots 0 & y_1 & y_2 & y_3 & \ldots y_n \\ x_1 & x_2 & x_3 & \ldots x_n & 0 & 0 & 0 & \ldots 0 \\ 0 & 0 & 0 & \ldots 0 & x_1 & x_2 & x_3 & \ldots x_n \\ 1 & 1 & 1 & \ldots 1 & 0 & 0 & 0 & \ldots 0 \\ 0 & 0 & 0 & \ldots 0 & 1 & 1 & 1 & \ldots 1 \end{pmatrix}$$

Comparison of relations (6) and (8) shows that a7=1. Using this fact, relation (11) above can be simplified to relation (12) below:

$$(y'_1, y'_2, y'_3 \ldots, y'_n, x'_1 - x_1, x'_2 - x_2, x'_3 - x_3 \ldots, x'_n - x_n) = (a1\ \ a2\ a6\ a3\ \ a4\ \ a8) \tag{12}$$

$$\begin{bmatrix} xy_1 & xy_2 & xy_3 & \ldots xy_n & -y_1^2 & -y_2^2 & -y_3^2 & \ldots -y_n^2 \\ y_1 & y_2 & y_3 & \ldots y_n & 0 & 0 & 0 & \ldots 0 \\ 0 & 0 & 0 & \ldots 0 & y_1 & y_2 & y_3 & \ldots y_n \\ x_1 & x_2 & x_3 & \ldots x_n & 0 & 0 & 0 & 0 \\ 1 & 1 & 1 & \ldots 1 & 0 & 0 & 0 & 0 \\ 0 & 0 & 0 & \ldots 0 & 1 & 1 & 1 & \ldots 1 \end{bmatrix}$$

Now, when the relationship Q=RS is true for three matrices Q, R and S, then the following relationships are also true:

$$QS^T=RSS^T \text{ and } QS^T(SS^T)^{-1}=R$$

where $S^T$ is the transform of matrix S and $(SS^T)^{-1}$ is the inverse of $(SS^T)$. Thus, the matrix R can be found by computing $QS^T(SS^T)^{-1}$. If the matrix to the left of the equals sign in relation (12) takes the place of matrix Q above, the matrix of coefficients (a1 a2 a6 a3 a4 a8) in relation (12) takes the place of matrix R above, and the second matrix to the right of the equals sign in relation (12) takes the place of matrix S above, it will be seen that the matrix of coefficients (a1 a2 a6 a3 a4 a8) can be determined by computing $QS^T(SS^T)^{-1}$.

Accordingly, the processor may determine the values of the coefficients (a1 a2 a6 a3 a4 a8) by implementing the computation mentioned in the preceding paragraph using the coordinates $(x_1,y_1)$, $(x_2,y_2)$, $(x_3,y_3)$, . . . , $(x_n,y_n)$, and $(x'_1,y'_1)$, $(x'_2,y'_2)$, $(x'_3,y'_3)$, of the matched crossing points in the scan image and in the reference pattern. However, the values of the coefficients (a1 a2 a6 a3 a4 a8) change with page velocity. Thus the values of the coefficients (a1 a2 a6 a3 a4 a8) may be different for pixel locations that are imaged at different times (i.e. at times when different page velocity values apply). Accordingly, to obtain results of good accuracy, different values of this set of coefficients may be computed for different small regions in the reference pattern, i.e. small regions for which it may be assumed that page velocity is constant. In such a case the computation uses coordinates of crossing points that are in the relevant small area of the reference pattern (or which define corners of the small region) as well as the coordinates of their matched crossing points in the scan image. For example, for high precision the computation may use coordinates of four crossing points in the reference pattern that define corners of a minimum-size quadrilateral in the reference pattern.

When the processor 10 can compute values for the coefficients (a1 a2 a6 a3 a4 a8) then, bearing in mind that a1=−a5 and a7=1, the processor would then have values of all the coefficients needed to be able to transform coordinates (x,y) in the scan image plane to coordinates (x',y') in the reference pattern plane using relations (7) and (8) above.

The processor 10 may determine the inverse transformations needed to transform the coordinates (x',y') of points in the reference pattern plane to coordinates (x,y) of corresponding points in the scan image plane, as follows.

Relation (7) above can be rewritten as relation (13) below:

$$a1yx+a2y-y'+a3x+a4=0 \tag{13}$$

and relation (8) above may be rewritten as relation (14) below:

$$x=\frac{x'-a5y^2-a6y-a8}{a7} \tag{14}$$

Substituting the right-hand side of relation (14) for parameter x in relation (13) yields relation (15) below:

$$\frac{a1}{a7}yx'-\frac{a1a5}{a7}y^3-\frac{a1a6}{a7}y^2-\frac{a1a8}{a7}y+a2y-y'+\frac{a3}{a7}x'-\frac{a3a5}{a7}y^2-\frac{a3a6}{a7}y-\frac{a3a8}{a7}+a4=0 \tag{15}$$

and this may be rewritten as relation (16) below:

$$\left(\frac{a1a5}{a7}\right)y^3+\left(\frac{a3a5}{a7}+\frac{a1a6}{a7}\right)y^2+\left(-\frac{a1}{a7}x'+\frac{a1a8}{a7}+\frac{a3a6}{a7}-a2\right)y+\left(y'-\frac{a3}{a7}x'+\frac{a3a8}{a7}+a4\right)=0 \tag{16}$$

In practice the coefficient of the $y^3$ term in relation (16) is very close to zero in value so the third order term can be ignored, producing relation (17) below:

$$\left(\frac{a3a5}{a7}+\frac{a1a6}{a7}\right)y^2+\left(-\frac{a1}{a7}x'+\frac{a1a8}{a7}+\frac{a3a6}{a7}-a2\right)y+\left(y'-\frac{a3}{a7}x'+\frac{a3a8}{a7}+a4\right)=0 \tag{17}$$

which is a quadratic equation. Solving this quadratic equation for y yields relation (18) below:

$$y=\frac{-B\pm\sqrt{B^2-4AC}}{2*A} \tag{18}$$

where $$A=\left(\frac{a3a5}{a7}+\frac{a1a6}{a7}\right)$$

$$B=\left(-\frac{a1}{a7}x'+\frac{a1a8}{a7}+\frac{a3a6}{a7}-a2\right)$$

and $$C=\left(y'-\frac{a3}{a7}x'+\frac{a3a8}{a7}+a4\right)$$

When the processor 10 can determine values for the coefficients a1 to a8 using the coordinates of matched crossing points as described above, the processor 10 can perform transformations from coordinates (x',y') in the reference pattern to coordinates in the scan image (x,y) using the coefficient values and using relations (18) and (14) above. Moreover, the (x,y) coordinates in the scan image that corresponds to given (x',y') coordinates in the reference pattern can be determined to sub-pixel accuracy.

When the processor 10 has determined transformations that enable it to convert between coordinates of points in the scan image and reference pattern the processor can estimate page velocity during the imaging process by any convenient technique. One example of a technique for estimating page velocity using the transformations will now be described with reference to FIG. 7.

Figure 7:
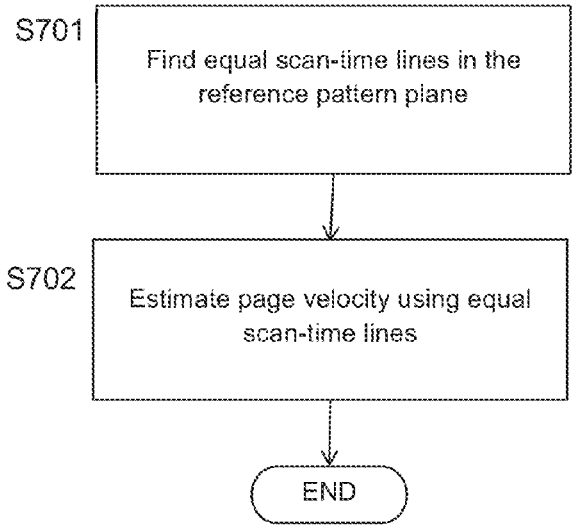
FIG. 7 is a flow diagram illustrating an example of a process, that may be used in the method of FIG. 4, for estimating page velocity based on displacements between points in a reference pattern and points in a scan image generated by imaging the reference pattern.

In step S701 of FIG. 7, the processor identifies positions of points in the reference pattern that correspond to equal scan time lines (in other words, points in the reference pattern that were imaged at the same time). In step S702 of FIG. 7, the processor then computes estimates of page velocity based on the positions of pixels in the reference pattern that were imaged at the same time, and based on knowledge of the time when those pixels were imaged.

In the scan image, pixels that have the same y-coordinate value were scanned at the same detection time (in a case where the page-transport direction corresponds to the y-direction in the scan image). Thus, in principle the positions (x',y') in the reference pattern that correspond to equal scan-time lines may be identified by using relations (7) and (8) above to compute the positions in the reference image that correspond to coordinates of pixels in the scan image that have the same y-coordinate value. However, if the same values of the coefficients (a1 a2 a6 a3 a4 a8) are used when applying relations (7) and (8) to compute the reference pattern pixels which correspond to all the pixels having the same y-coordinate value in the scan image good accuracy of the results will not be assured.

One technique for finding, to sub-pixel accuracy, the positions in the reference pattern that correspond to equal scan-time lines is, as follows:

The processor 10 builds two double grey level images according to location (y and x) found in the previous stage. In each of these images the color corresponds to pixel location in the scan image.

The processor extracts sets of constant-y lines' coordinates (equal scan-time lines).

For each of the equal scan-time lines, the processor finds—on the two double grey-level images—the set of pixels having the closest grey level to the line coordinate (y and x).

Using bilinear interpolation, the processor finds the locations (to sub-pixel precision) of points in the reference pattern that correspond to equal scan-time lines.

One example method will now be described by which the processor may build the two double grey level images, i.e. a first grey-level image X in which grey level values represent y-coordinate values in the scan image, and a second grey-level image Y in which grey levels represent x-coordinate values in the scan image.

To calculate the grey level of a pixel at location (i,j) in x and the grey level of a pixel at location (i,j) in Y:

Identify a set $CP_{(i,j)}^{Ref}$ of the crossing points in the reference pattern that are close to the location (x',y')=(i,j)

Find the set $CP_{(i,j)}^{Scanimage}$ of the crossing points in the scan image that are matched to the crossing points in set $CP_{(i,j)}^{Ref}$.

Compute values $V_{(I,j)}$ for the coefficients (a1 to a4, a6 and a8) by computing a matrix of the form $QS^T(SS^T)^{-1}$ as discussed above and the coordinates of the matched crossing points in set $CP_{(i,j)}^{Ref}$ and set $CP_{(i,j)}^{Scanimage}$.

Using the values $V_{(I,j)}$ for the coefficients (a1 to a4, a6 and a8), using a5=−a1, using a7=1, and using the reference-image-plane coordinates (x',y')=(i,j) use relations (14) and (18) above to compute x and y coordinate values.

Set the grey level of the pixel at location (i,j) in grey level image X dependent on the magnitude of the y coordinate value computed in the foregoing step, and set the grey level of the pixel at location (i,j) in grey level image Y dependent on the magnitude of the x coordinate value computed in the foregoing step.

Repeat the above-described steps for all possible pixel locations (i,j), that is, for i values sufficient to cover the whole width of the page bearing the reference pattern and for j values sufficient to cover the whole length of the original page bearing the reference pattern.

Figure 8A:
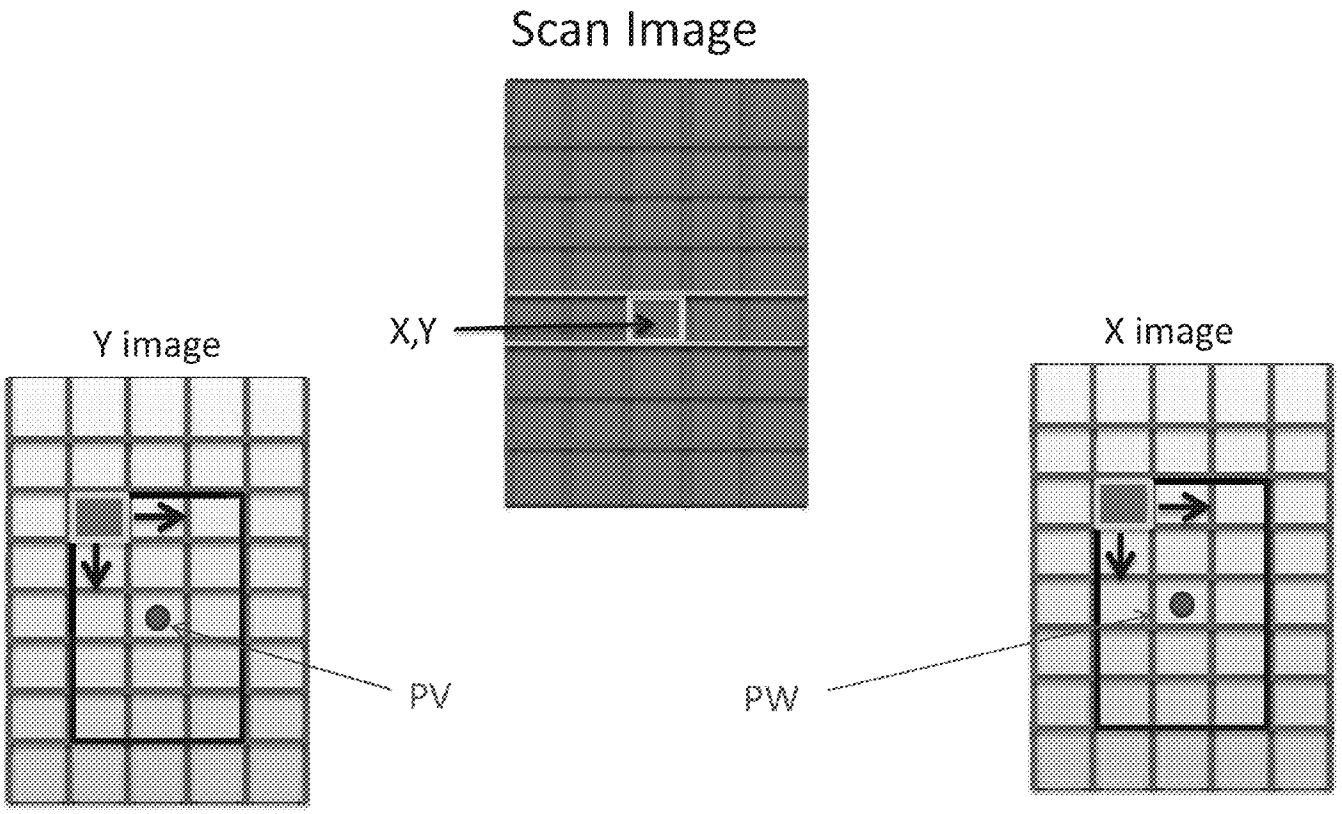
FIGS. 8A and 8B are diagrams illustrating an example of a process employed by a processor to find, on two double grey-level images, a set of pixels having the closest grey level to certain line coordinates.
Figure 8B:
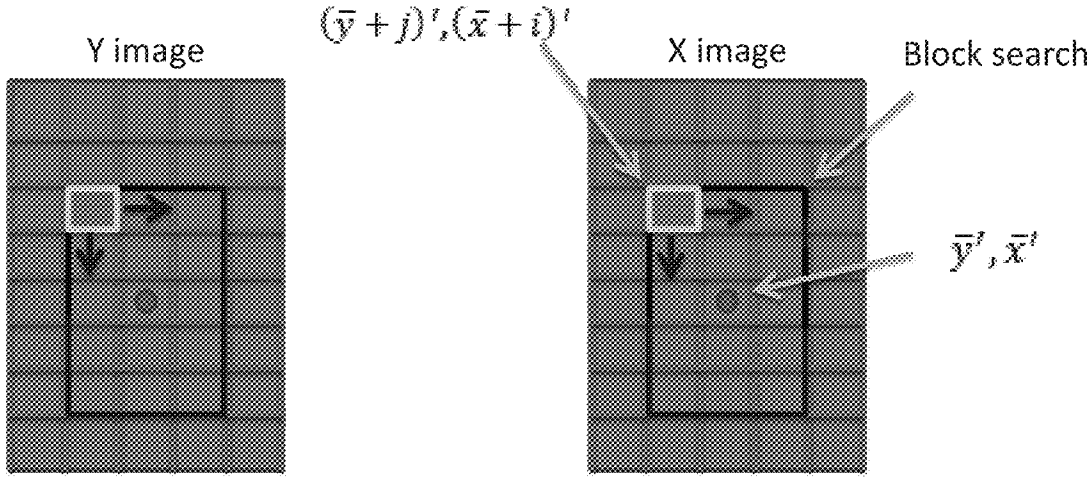

FIGS. 8A and 8B illustrate how the processor finds—on the two double grey-level images—the set of pixels having the closest grey level to the line coordinate (y and x).

For a given pixel $(x_r,y_r)$ in the scan image (notably a pixel that is on a target equal-scan-time line), the processor 10 searches for a common pixel location (i,j) in the Y and X grey-level images where the grey levels, in the respective grey-level images, are as close as possible to the coordinate values $(x_r,y_r)$. To do this, the processor 10 predicts a location PV in the Y image where it might be expected that the grey level will correspond to $x_r$ and predicts a location PW in the X image where it might be expected that the grey level will correspond to $y_r$ (in one example PV and PW may be set equal to $(x_r,y_r)$). The grey levels at the predicted points PV, PW may not, after all, be the values that correspond to $x_r$ and $y_r$ so, in each of the grey-level images, a search is performed in a search region around the predicted point, looking in the two images for a common pixel location where the grey levels are as close as possible to $x_r$ and $y_r$. The location of this common pixel corresponds—to the nearest pixel—to the pixel location $(x_r',y_r')$ in the reference image that gave rise to the pixel $(x_r,y_r)$ in the scan image.

Figure 9:
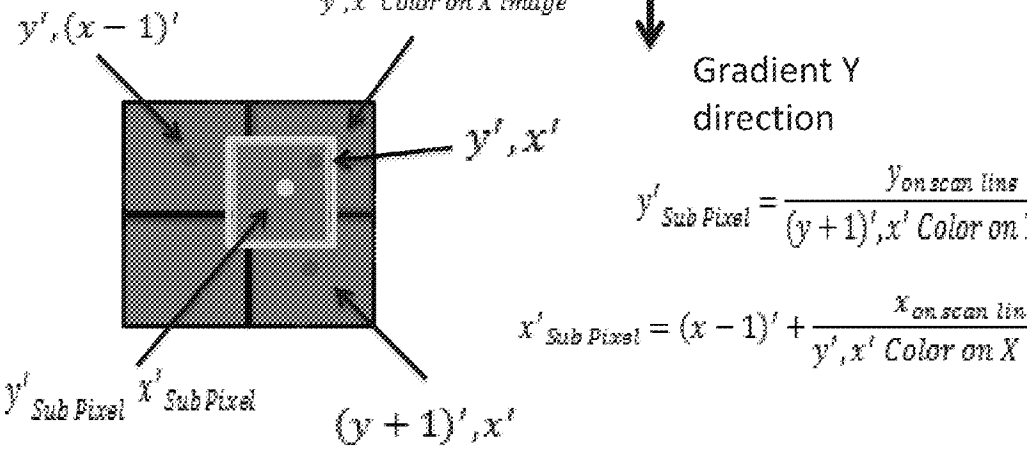
FIG. 9 is a diagram illustrating use of bilinear interpolation to find locations of points in a reference pattern that correspond to equal scan-time lines.

When it is desired to find the pixel location $(x_r',y_r')$ in the reference image that gave rise to the pixel $(x_r,y_r)$ in the scan image to sub-pixel accuracy the method illustrated in FIG. 9 may be used. FIG. 9 illustrates how the processor uses bilinear interpolation, using the neighbours of the common pixel found by the method of FIGS. 8A and 8B, to find the locations (to sub-pixel precision) of points in the reference pattern that correspond to the equal scan-time lines. The formulae used in the bilinear interpolation are shown in FIG. 9.

When the processor 10 has found points in the reference pattern that correspond to equal scan time lines, the processor 10 may compute values for page velocity from the equal scan time line data (step S702 in FIG. 7). The computed velocity values may include values $v_x$ corresponding to translational velocity in the x direction, values $v_y$ corresponding to translational velocity in the y direction, and values w corresponding to rotational velocity in the plane of the page. The processor 10 may compute plural sets of velocity values for the page, and each set of velocity values may relate to a short time interval during the imaging of the reference pattern, for example a time interval between two successive detection periods (i.e. a time interval between generation of two successive line images by the in-line scanning unit 8).

One example of a method by which the processor 10 may compute values for page velocity from the equal scan time line data in step S702 in FIG. 7 shall now be described.

The coordinates of points on equal scan-time lines in the scan image can be transformed to coordinates of corresponding points on equal scan-time lines in the reference pattern according to relations (19) and (20) below:

$$y'=y+(x-x_0)(\varnothing+w\Delta t)+v_y\Delta t+y_c \tag{19}$$

$$x'=(y-y_0)(-\varnothing-w\Delta t)+x+v_x\Delta t+x_c \tag{20}$$

where Δt corresponds to the interval between the scan times of two equal-scan-time lines in the scan image (which may be separated from each other by one or more than one lines in the scan image). It will be seen that relations (19) and (20) resemble relations (3) and (4) above. Coordinate data relating to the whole of an equal scan time line can be transformed according to relations (21) and (22) below:

$$(y_1', y_2', y_3' \ldots, y_n') = (a_y\ b_y\ c_y)\begin{pmatrix} y_1 & y_2 & y_3 & \ldots & y_n \\ x_1 & x_2 & x_3 & \ldots & x_n \\ 1 & 1 & 1 & \ldots & 1 \end{pmatrix} \tag{21}$$

where $a_y=1$, $b_y=(\varnothing+w\Delta t)$, and $c_y=v_y\Delta t+y_c-x_0(\varnothing+w\Delta t)$ and $$(x_1', x_2', x_3' \ldots, x_n') = (a_x\ b_x\ c_x)\begin{pmatrix} x_1 & x_2 & x_3 & \ldots & x_n \\ y_1 & y_2 & y_3 & \ldots & y_n \\ 1 & 1 & 1 & \ldots & 1 \end{pmatrix} \tag{22}$$

where $a_x=1$, $b_x=-(\varnothing+w\Delta t)$, and $c_x=v_x\Delta t+x_c+y_0(\varnothing+w\Delta t)$ Relations (21) and (22) may be combined to form relation (23) below:

$$\begin{aligned}(y_1'-y_1, y_2'-y_2, y_3'-y_3 \ldots, \\ y_n'-y_n, x_1'-x_1, x_2'-x_2, x_3'-x_3 \ldots, x_n'-x_n) = \\ (b_y\ c_y\ c_x)\begin{bmatrix} x_1 & x_2 & x_3 & \ldots x_n & -y_1 & -y_2 & -y_3 & \ldots -y_n \\ 1 & 1 & 1 & \ldots 1 & 0 & 0 & 0 & \ldots 0 \\ 0 & 0 & 0 & \ldots 0 & 1 & 1 & 1 & \ldots 1 \end{bmatrix}\end{aligned} \tag{23}$$

As mentioned above, when the relationship Q=RS is true for three matrices Q, R and S, the relationships $QS^T=$ $RSS^T$ and $QS^T(SS^T)^{-1}=R$ are also true. If the matrix to the left of the equals sign in relation (23) takes the place of matrix Q above, the matrix of coefficients ($b_y$ $c_y$ $c_x$) in relation (23) takes the place of matrix R above, and the second matrix to the right of the equals sign in relation (23) takes the place of matrix S above, it will be seen that the matrix of coefficients ($b_y$ $c_y$ $c_x$) can be determined by computing $QS^T(SS^T)^{-1}$.

Let us designate as ($b_{yT}$, $c_{yT}$, $c_{xT}$) a first set of values for the coefficients ($b_y$ $c_y$ $c_x$) that depends on coordinate data relating to an equal scan-time line relating to the scan time t=T, and let us designate as ($b_{yT+\Delta t}$, $c_{yT+\Delta t}$, $c_{xT+\Delta t}$) a second set of values for the coefficients ($b_y$ $c_y$ $c_x$) that depends on coordinate data relating to an equal scan-time line relating to the scan time t=T+Δt (where Δt is small so that the assumptions relating to small areas discussed above apply: for example the scan times t=T and t=T+Δt may be successive detection times when the in-line sensing unit 8 images the page, or scan times with a short interval between them). Differences between the first and second sets of values for the coefficients ($b_y$ $c_y$ $c_x$) may be expressed using relations (24) to (26) below:

$$b_{yT+\Delta t}-b_{yT}=(\emptyset+w\Delta t)-(\emptyset+0w)=w\Delta t \tag{24}$$

$$\begin{aligned} c_{yT+\Delta t}-c_{yT}&=v_y\Delta t+y_c-x_0(\emptyset+w\Delta t)-(v_y0+y_c-x_0(\emptyset+w0)\\ &=v_y\Delta t-x_0w\Delta t \end{aligned} \tag{25}$$

$$\begin{aligned} c_{xT+\Delta t}-c_{xT}&=v_x\Delta t+x_c+y_0(\emptyset+w\Delta t)-(v_x0+x_c+y_0(\emptyset+w0)\\ &=v_x\Delta t+y_0w\Delta t \end{aligned} \tag{26}$$

It will be seen that page velocity values $v_x$, $v_y$ and w appear in the results. These are estimates of velocity values applicable during the interval from t=T to t=T+Δt (which may be the interval between successive scan times or a somewhat longer interval).

The result data may be smoothed as illustrated in FIG. 10 using Savitzky-Golay convolution and based on assumptions that, in a short time, $v_x$ and $v_y$ are constant, and $x_0$ and $y_0$ are constant, and any acceleration derives from change in the rotational velocity w. Vx and $v_y$ are calculated according to the neighbour scan time lines found as discussed above. Local calculations are used for each area, computing $QS^T(SS^T)^{-1}$ as described. FIG. 10 shows relations that derive from the assumption of constant velocity over a small area in the image (in which the w values are extracted from processing of previous stages described above), and relations that derive from the assumption of constant acceleration over a small area. In these relations, $v_x'$ is the x "velocity" calculated at the previous stage ($v'_{x1}=y_0W_1+v_x$) and $v_y'$ is the y "velocity" calculated at the previous stage ($v'_{y1}=x_0W_1+v_y$).

The processor 10 may be configured to use the above example method to estimate plural sets of page velocity values $v_x$, $v_y$ and w, each set of values being applicable during a different time interval occurring during the imaging process. If these time intervals are spaced regularly over the imaging period then the processor generates page velocity data that represents a profile of how the page velocity varied during the imaging process.

When the processor 10 is arranged to compute sets of velocity estimates for a large number of time intervals during the imaging process this has the advantage of providing detailed data regarding the characteristics of the relative motion between the page and the in-line sensing unit during the imaging process. Detailed data of this kind makes it easier to make a precise diagnosis of problems affecting the mechanisms producing the relative displacement between the substrate and the sensing unit. In a similar way, detailed data of this kind enables the processor to identify with greater precision regions in the scan image that were generated at times when the page velocity was stable and/or when the page velocity was at or close to the nominal setting.

When the processor 10 is arranged to compute sets of velocity estimates for a small number of time intervals during the imaging process this has the advantage of reducing the computational load on the processor 10.

Devices which have the function of estimating how the velocity of a substrate varies during the relative displacement between the substrate and an image sensing unit that images the substrate can implement various remedial measures. For example, the estimated velocity values can be used to diagnose and/or correct problems in a mechanism which transports the substrate relative to the sensing unit or which transports the sensing unit relative to the substrate. As another example, the estimated velocity values may enable a processor associated with the scanning unit to identify regions in the scan image where the relative velocity of displacement between the substrate and the sensing unit is stable and/or close to a nominal direction and magnitude. Such regions may then be used by the processor in preference to other regions when the processor performs functions such as calibration that involve processing of scan image data.

An example of a printing device 1 according to the invention is illustrated in a schematic manner in FIG. 1. As mentioned above, the printing device 1 according to this example includes a processor 10. The processor 10 may be arranged to implement any of the page-velocity estimation methods described above. The processor may be arranged to perform the selected page-velocity estimation method by loading an appropriate application program or routines, for example from a memory (not shown) associated with the printing device 1, of from any other convenient source (uploading via a network, loading from a recording medium, and so on).

The processor 10 of the printing device 1 of FIG. 1 may be arranged to use page-velocity estimates produced by implementing the above-described page-velocity estimation methods in a diagnosis method that diagnoses imperfections in the page transport mechanism 3, 3' that transports pages past the scanning unit 8. Based on the page velocity estimates, the processor 10 may diagnose a particular imperfection in the page transport mechanism 3,3'. The processor 10 may be arranged to output information about the result of the diagnosis, for example so that the information can be logged, displayed to a user, and so on. The processor 10 may be arranged to implement remedial action to correct the diagnosed imperfection. Some examples of such remedial action will be given below but it is to be understood that the invention is not limited to these examples.

For example, the processor 10 may determine, based on the page velocity estimates, that there is a periodic variation in the magnitude of the velocity at which the page transport mechanism 3,3' feeds pages past the scanning unit 8, or there is a systematic deviation from the nominal magnitude of page velocity. In such a case, the processor 10 may be arranged to implement remedial action by appropriate control of a servo mechanism (not shown) that drives the page transport mechanism 3,3', notably control to adjust the magnitude of the page-feed speed to counteract the diagnosed periodic variation or systematic deviation from nominal speed.

As another example, the processor 10 may be arranged to determine, based on the page velocity estimates, that the page transport mechanism 3,3' feeds pages past the scanning unit 8 at a skew relative to the nominal page orientation and/or rotates pages during their passage past the scanning unit 8. In such a case, the processor 10 may be arranged to implement remedial action by making an automatic adjustment of the positioning/orientation of mechanical components forming part of the page transport mechanism 3,3'.

The processor 10 of the printing device 1 of FIG. 1 may be arranged to use page-velocity estimates produced by implementing the above-described page-velocity estimation methods to improve a calibration method performed by the processor 10 (or by an associated device). When a calibration method is based on data obtained from a scan image, the results of the calibration will be impaired if there is distortion in the scan image, for example distortion caused by variation in the substrate velocity relative to the scanning unit during the imaging process. Accordingly, the processor 10 of the printing device 1 of FIG. 1 may be arranged to implement a method to select, for use in a calibration process, regions in a scan image that were imaged while the velocity of displacement of the substrate relative to the scanning unit was close to the nominal value, or at least was stable, according to the page-velocity estimates produced by implementing the above-described page-velocity estimation methods. The processor may use page velocity estimation methods according to examples of the invention to determine the maximum image correlation length, that is, the maximum area of the image where there is no difference between the pattern on the imaged substrate and the scan image.

Figure 11:
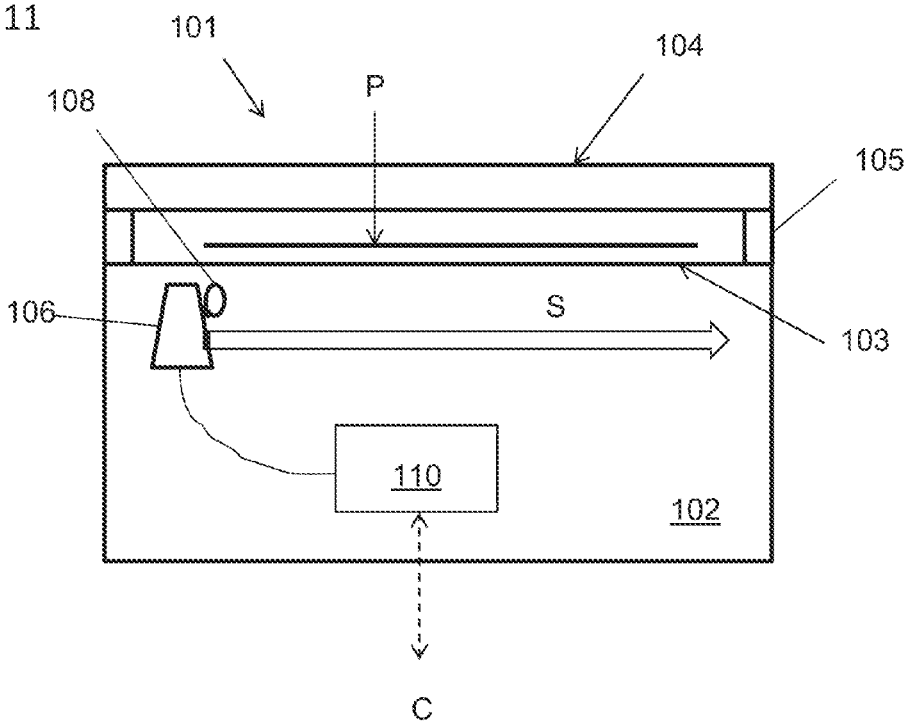
FIG. 11 is a schematic representation of an imaging device that can implement page-velocity estimation methods according to an example of the invention.

An imaging device 101 according to one example of the invention will now be described with reference to FIG. 11. In the example of FIG. 11 the imaging device 101 is a flat-bed scanner, but the invention is not limited to imaging devices of this type.

In the flat-bed scanner 101 of FIG. 11, a base portion 102 of the scanner provides a transparent surface 103 for reception of a page P to be imaged. A lid portion 104 of the scanner 101 is supported by side portions 104 and can be raised and lowered to enable pages to be placed on and removed from the transparent surface 103. The scanner 101 includes an in-line scanning unit 106 that is mounted for movement in a direction S from one end of the surface 103 to the other so that it can image the whole surface of a page P that is present on the transparent surface 103, and for return in the reverse direction. The in-line scanning unit 106 carries a light source 108 to provide light to illuminate the surface of the page P facing the transparent surface 103.

The flat-bed scanner 101 illustrated in FIG. 11 includes a processor 110 arranged to control the components of the scanner 101 and to receive scan image data from the sensing unit 106. The processor 110 of the imaging device 101 of FIG. 11 may be arranged to communicate with an external device C, for example to transmit to C image data generated by the sensing unit 106. The processor 110 of the imaging device 101 of FIG. 11 may be arranged to implement any of the page-velocity estimation methods described above. The processor 110 may be arranged to perform the selected page-velocity estimation method by loading an appropriate application program or routines, for example from a memory (not shown) associated with the imaging device 101, of from any other convenient source (uploading via a network, loading from a recording medium, and so on).

The processor 110 of the imaging device 101 of FIG. 11 may be arranged to use page-velocity estimates produced by implementing the above-described page-velocity estimation methods in diagnosis methods that diagnose imperfections in a mechanism (not shown) that transports the scanning unit 106 and/or to diagnose imperfections in the functioning of the scanning unit 106 itself. The processor 110 may be arranged to implement any suitable remedial action based on the result of its diagnosis.

The processor 110 of the imaging device 101 of FIG. 11 may be arranged to use page-velocity estimates produced by implementing the above-described page-velocity estimation methods in calibration methods that calibrate the scanning unit 106. For example, the processor 110 may be arranged (as mentioned above in connection with the processor 10 of the printing device 1) to select particular regions of the scan image for use in a calibration process: these may be image regions where the processor 110 has determined there will be no difference between the scan image and the original pattern on the substrate.

Although certain examples of methods, printing devices and imaging devices have been described, it is to be understood that changes and additions may be made to the described examples within the scope of the appended claims.

For example, although the above description mentions particular calibration processes, page-velocity estimation methods according to examples of the invention may be used to provide page-velocity information for use in other calibration methods including but not limited to:

calibration of a printing mechanism in a printing device calibration of a point spread function of a scanner or other imaging device calibration of offsets observed between markings that are printed using different colors but supposed to have a specified spatial relationship calibration of the shape and/or size of the point of a laser beam used in the writing module of a printing device.

What is claimed is:

1. A method of determining relative displacement velocity between an image sensor and a substrate, the method comprising:

causing relative displacement between the image sensor and the substrate, a reference pattern being marked on the substrate, the reference pattern comprising plural crossing points at predetermined locations on the substrate, each crossing point comprising a first line portion crossing a second line portion;

during the relative displacement of the image sensor and substrate, generating, by the image sensor, image data representing the reference pattern;

supplying the image data representing the reference pattern to a processor;

detecting by the processor, in the image data, locations corresponding to the crossing points;

determining relationships between the predetermined locations on the substrate and the detected locations in the image data;

selecting first and second equal scan-time lines in the image data, each equal scan-time line including a plurality of points;

computing a plurality of points on the substrate that correspond to the plurality of points in each equal scan-time line based on the relationships;

calculating first and second sets of values to convert the plurality of points in the first and second equal scan-time lines respectively to the corresponding pluralities of points on the substrate; and producing an estimate of the velocity of the relative displacement between the image sensor and the substrate and an estimate of a rotational velocity of the substrate based on differences between the first set of values and the second set of values.

2. The method according to claim 1, wherein the first line portion and the second line portion are perpendicular to each other.

3. The method according to claim 2, wherein said detecting, in the image data, of the locations corresponding to the crossing points comprises:

performing, by the processor, a first convolution of the image data with a first kernel to produce a first convolution result, the first kernel corresponding to a first straight line portion having a first orientation;

performing, by the processor, a second convolution of the image data with a second kernel to produce a second convolution result, the second kernel corresponding to a second straight line portion perpendicular to the first straight line portion;

performing, by the processor, multiplication of the first convolution result with the second convolution result to produce a convolution product;

detecting intensity peaks in the convolution product; and registering locations of intensity peaks in the convolution product as the locations of crossing points in said image data.

4. The method according to claim 3, and further comprising:

repeating the performing steps to produce further convolution products and using, in the production of the further convolution products, further first kernels corresponding to respective straight line portions oriented at different angles from each other and from the first straight line portion;

generating a synthetic image by the processor, the intensity of each pixel in the synthetic image being set to a maximum intensity value at this pixel location found by the processor in the convolution product and further convolution products;

detecting, by the processor, locations of centers of the intensity peaks in the synthetic image; and registering, as the locations of crossing points in said image data, the locations of centers of the intensity peaks in the synthetic image.

5. The method according to claim 4, and further comprising binarizing the synthetic image by the processor before said detecting of the locations of the centers of intensity peaks, the detecting of the locations of the centers of intensity peaks comprising detecting locations of the centers of intensity peaks in the binarized synthetic image, and the registering comprising registering the locations of the centers of intensity peaks in the binarized synthetic image as the locations of crossing points in said data.

6. The method according to claim 1, and further comprising:

matching crossing point locations in the image data to crossing points in the reference pattern by the processor performing a recursive search process, the recursive search process comprising matching a crossing point location at a reference position in the image data to a crossing point at a reference position in the reference pattern and matching further crossing points in the image data to further crossing points in the reference pattern by:

computing, for crossing points in the reference pattern, predicted locations of matching crossing points in the image data, based on locations in the image data of crossing points matched to neighbors of the crossing points in the reference pattern and based on spacings between crossing points in the reference pattern, defining a respective search region around each predicted crossing point location in the image data, and matching to a crossing point in the reference pattern a crossing point in the image data that is located in the search region defined around the predicted matching crossing point location.

7. The method according to claim 1, wherein the image sensor comprises an in-line sensing unit configured to image lines across the substrate at respective detection times.

8. The method according to claim 7, wherein the production of the estimate of the velocity of the relative displacement between the image sensor and the substrate includes determining locations in the reference pattern that correspond to lines of image data generated by the in-line sensing unit at respective detection times.

9. A printer comprising:

an image sensor; and a processor to:

cause relative displacement between the image sensor and a substrate on which is marked a reference pattern, the reference pattern comprising plural crossing points at predetermined locations on the substrate, each crossing point comprising a first line portion crossing a second line portion;

receive, from the image sensor, image data representing the reference pattern, the image data generated by the image sensor during the relative displacement of the image sensor and substrate;

detect, in the image data, locations corresponding to the crossing points by:

performing a first convolution of the image data with a first kernel to produce a first convolution result, the first kernel corresponding to a first straight line portion having a first orientation, performing a second convolution of the image data with a second kernel to produce a second convolution result, the second kernel corresponding to a second straight line portion perpendicular to the first straight line portion, performing multiplication of the first convolution result with the second convolution result to produce a convolution product, detecting intensity peaks in the convolution product, and registering locations of intensity peaks in the convolution product as the locations of crossing points in said image data;

determine relationships between the predetermined locations on the substrate and the detected locations in the image data; and produce an estimate of a velocity of the relative displacement between the image sensor and the substrate using the determined relationships.

10. The printer of claim 9, wherein the first line portion and the second line portion are perpendicular to each other.

11. A method of determining relative displacement velocity between an image sensor and a substrate, the method comprising:

causing relative displacement between the image sensor and the substrate, a reference pattern being marked on the substrate, the reference pattern comprising plural crossing points at predetermined locations on the substrate, each crossing point comprising a first line portion crossing a second line portion;

during the relative displacement of the image sensor and substrate,. generating, by the image sensor, image data representing the reference pattern;

supplying the image data representing the reference pattern to a processor;

detecting by the processor, in the image data, locations corresponding to the crossing points;

determining relationships between the predetermined locations on the substrate and the detected locations in the image data, wherein determining the relationships includes:

matching crossing point locations in the image data to crossing points in the reference pattern by the processor performing a recursive search process, the recursive search process comprising matching a crossing point location at a reference position in the image data to a crossing point at a reference position in the reference pattern and matching further crossing points in the image data to further crossing points in the reference pattern by:

computing, for crossing points in the reference pattern, predicted locations of matching crossing points in the image data, based on locations in the image data of crossing points matched to neighbors of the crossing points in the reference pattern and based on spacings between crossing points in the reference pattern, defining a respective search region around each predicted crossing point location in the-image data, and matching to a crossing point in the reference pattern a crossing point in the image data that is located in the search region defined around the predicted matching crossing point location; and producing an estimate of the velocity of the relative displacement between the image sensor and the substrate using the determined relationships.

12. The method of claim 1, further comprising generating a mapping relating points on the substrate to points in the image data based on the relationships, wherein computing the plurality of points on the substrate based on the relationships comprises computing the plurality of points on the substrate based on the mapping.

13. The method of claim 12, wherein generating the mapping comprises generating first and second mapping, and wherein a point on the substrate is added to the mapping by:

selecting a set of the predetermined locations that are near the point on the substrate to be added;

determining a set of the detected locations in the image data corresponding to the set of the predetermined locations;

computing a mapping from the substrate to the image data based on the set of the predetermined location and the set of the detected locations;

calculating first and second coordinates of a point in the image data corresponding to the point on the substrate; and associating the first coordinate with the point on the substrate in the first mapping and the second coordinate with the point on the substrate in the second mapping.

14. The method of claim 13, wherein computing the plurality of points in the reference pattern that correspond to the plurality of points in each equal scan-time line based on the relationships comprises, for a point in the equal scan-time lines, traversing the first and second mappings to find a point on the substrate that maps to coordinates nearest the point in the equal scan-time lines.

15. The method of claim 1, wherein producing the estimate of the velocity comprises:

determining the estimate of the rotational velocity of the substrate based on subtracting a first value in the first set of values from a first value in the second set of values; and determining the estimate of the velocity of the relative displacement between the image sensor and the substrate based on the rotational velocity and subtracting a second value in the first set of values from a second value in the second set of values.

16. The method of claim 1, wherein calculating the first set of values comprises solving a system of equations in which the first set of values relate coordinates of the plurality of points in the first equal scan-time line to differences between the coordinates of the plurality of points in the first equal scan-time line and coordinates of the corresponding plurality of points on the substrate.

* * * * *